US009217951B2

(12) United States Patent
Fujishima et al.

(10) Patent No.: US 9,217,951 B2
(45) Date of Patent: Dec. 22, 2015

(54) IMAGE FORMING APPARATUS WITH LEAKAGE DETECTING UNIT FOR DETECTING LEAKAGE

(71) Applicant: KYOCERA Document Solutions Inc., Osaka-shi, Osaka (JP)

(72) Inventors: Masashi Fujishima, Osaka (JP); Yoshinobu Yoneima, Osaka (JP); Tamotsu Shimizu, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/643,578

(22) Filed: Mar. 10, 2015

(65) Prior Publication Data

US 2015/0261127 A1 Sep. 17, 2015

(30) Foreign Application Priority Data

Mar. 17, 2014 (JP) ..... 2014-052912
Oct. 15, 2014 (JP) ..... 2014-210713

(51) Int. Cl.
*G03G 15/08* (2006.01)
*G03G 15/06* (2006.01)
*G03G 15/09* (2006.01)

(52) U.S. Cl.
CPC ..... *G03G 15/065* (2013.01); *G03G 15/0907* (2013.01)

(58) Field of Classification Search
CPC ..... G03G 15/0365
USPC ..... 399/55
See application file for complete search history.

(56) References Cited

U.S. PATENT DOCUMENTS

2014/0369705 A1* 12/2014 Matsui ..... G03G 15/065 399/55

FOREIGN PATENT DOCUMENTS

JP 2013-50481 3/2013

* cited by examiner

*Primary Examiner* — Quana M Grainger
(74) *Attorney, Agent, or Firm* — Gerald E. Hespos; Michael J. Porco; Matthew T. Hespos

(57) ABSTRACT

An image forming apparatus includes an image carrier, a developing device, a bias applying unit, a leakage detecting unit, a bias control unit and a leakage detection control unit. The developing device includes a magnetic roller and a developing roller. The magnetic roller carries a developer layer by being rotated. The developing roller receives the toner from the developer layer and supplies the toner to the image carrier. The leakage detection control unit performs a leakage detecting operation of detecting a value of an inter-peak voltage, at which the leakage occurred. The leakage detection control unit simultaneously starts the leakage detecting operation for a plurality of developing devices and performs the leakage detecting operations of the developing devices in which leakage simultaneously occurred while switching the leakage detecting operations one by one if the leakage simultaneously occurs in a plurality of developing devices at an inter-peak voltage.

18 Claims, 17 Drawing Sheets

FIG. 8

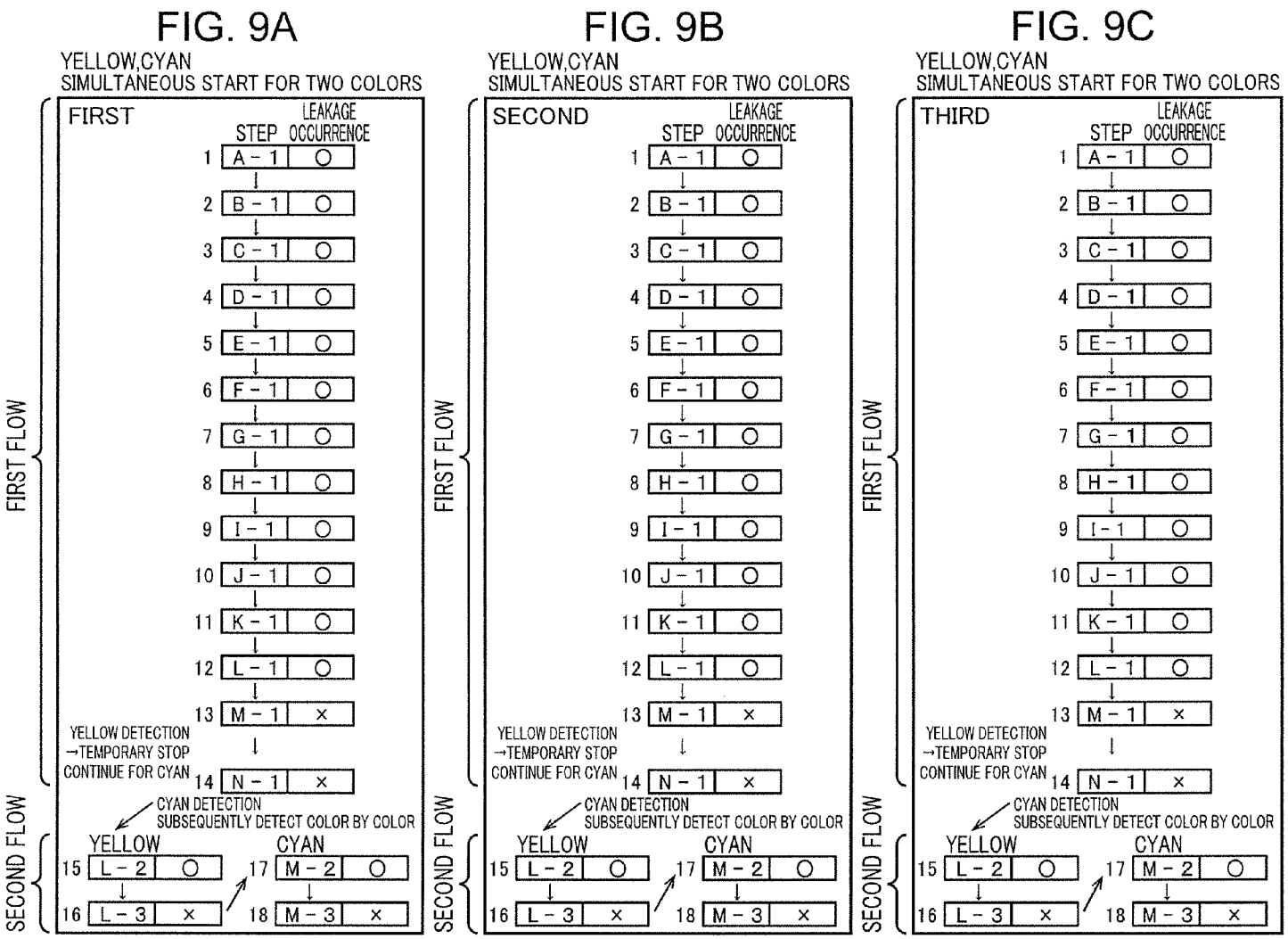
FIG. 9A
YELLOW,CYAN
SIMULTANEOUS START FOR TWO COLORS
FIRST
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 x
14 N-1 x
YELLOW DETECTION
→TEMPORARY STOP
CONTINUE FOR CYAN
CYAN DETECTION
SUBSEQUENTLY DETECT COLOR BY COLOR
YELLOW
15 L-2 O
16 L-3 x
CYAN
17 M-2 O
18 M-3 x
FIRST FLOW
SECOND FLOW
FIG. 9B
YELLOW,CYAN
SIMULTANEOUS START FOR TWO COLORS
SECOND
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 x
14 N-1 x
YELLOW DETECTION
→TEMPORARY STOP
CONTINUE FOR CYAN
CYAN DETECTION
SUBSEQUENTLY DETECT COLOR BY COLOR
YELLOW
15 L-2 O
16 L-3 x
CYAN
17 M-2 O
18 M-3 x
FIRST FLOW
SECOND FLOW
FIG. 9C
YELLOW,CYAN
SIMULTANEOUS START FOR TWO COLORS
THIRD
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 x
14 N-1 x
YELLOW DETECTION
→TEMPORARY STOP
CONTINUE FOR CYAN
CYAN DETECTION
SUBSEQUENTLY DETECT COLOR BY COLOR
YELLOW
15 L-2 O
16 L-3 x
CYAN
17 M-2 O
18 M-3 x
FIRST FLOW
SECOND FLOW

FIG. 10

FIRST TO FOURTH COLORS

| FIRST | | SECOND | | THIRD | |
|---|---|---|---|---|---|
| STEP | LEAKAGE OCCURRENCE | STEP | LEAKAGE OCCURRENCE | STEP | LEAKAGE OCCURRENCE |
| 1 A - 1 | ○ | 1 A - 1 | ○ | 1 A - 1 | ○ |
| 2 B - 1 | ○ | 2 B - 1 | ○ | 2 B - 1 | ○ |
| 3 C - 1 | ○ | 3 C - 1 | ○ | 3 C - 1 | ○ |
| 4 D - 1 | ○ | 4 D - 1 | ○ | 4 D - 1 | ○ |
| 5 E - 1 | ○ | 5 E - 1 | ○ | 5 E - 1 | ○ |
| 6 F - 1 | ○ | 6 F - 1 | ○ | 6 F - 1 | ○ |
| 7 G - 1 | ○ | 7 G - 1 | ○ | 7 G - 1 | ○ |
| 8 H - 1 | ○ | 8 H - 1 | ○ | 8 H - 1 | ○ |
| 9 I - 1 | ○ | 9 I - 1 | ○ | 9 I - 1 | ○ |
| 10 J - 1 | ○ | 10 J - 1 | ○ | 10 J - 1 | ○ |
| 11 K - 1 | ○ | 11 K - 1 | ○ | 11 K - 1 | ○ |
| 12 L - 1 | ○ | 12 L - 1 | ○ | 12 L - 1 | ○ |
| 13 M - 1 | × | 13 M - 1 | × | 13 M - 1 | × |
| 14 L - 2 | ○ | 14 L - 2 | ○ | 14 L - 2 | ○ |
| 15 L - 3 | × | 15 L - 3 | × | 15 L - 3 | × |

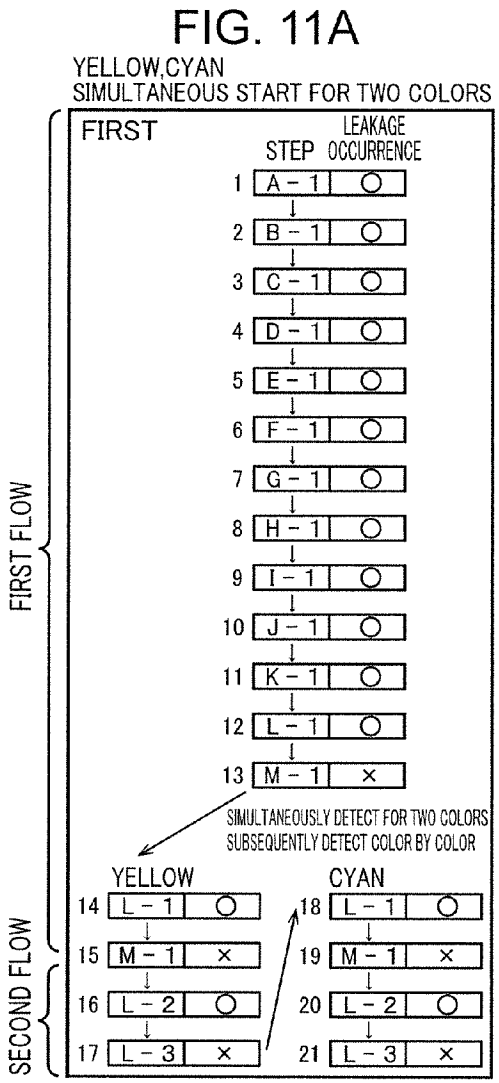
FIG. 11A
YELLOW,CYAN
SIMULTANEOUS START FOR TWO COLORS
FIRST
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 X
SIMULTANEOUSLY DETECT FOR TWO COLORS
SUBSEQUENTLY DETECT COLOR BY COLOR
YELLOW
14 L-1 O
15 M-1 X
16 L-2 O
17 L-3 X
CYAN
18 L-1 O
19 M-1 X
20 L-2 O
21 L-3 X
FIRST FLOW
SECOND FLOW

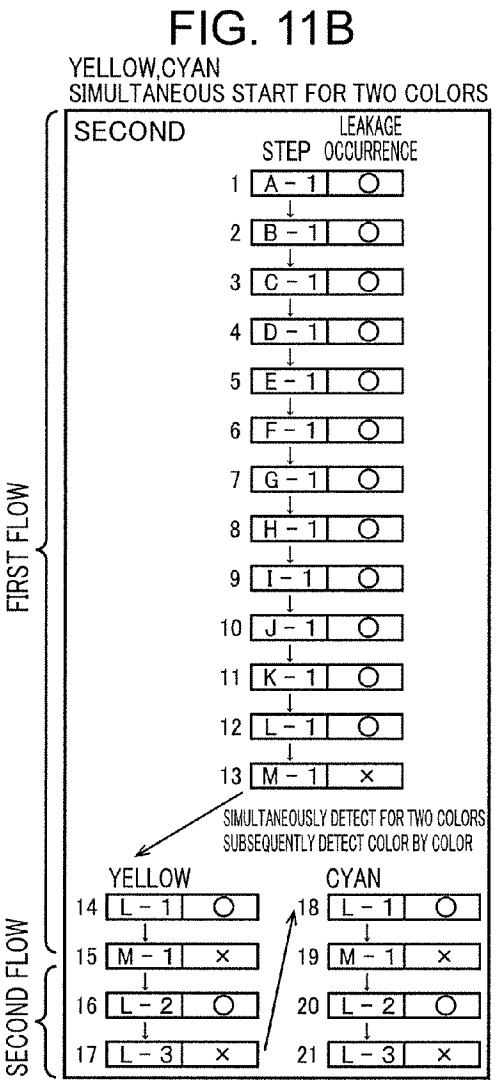
FIG. 11B
YELLOW,CYAN
SIMULTANEOUS START FOR TWO COLORS
SECOND
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 X
SIMULTANEOUSLY DETECT FOR TWO COLORS
SUBSEQUENTLY DETECT COLOR BY COLOR
YELLOW
14 L-1 O
15 M-1 X
16 L-2 O
17 L-3 X
CYAN
18 L-1 O
19 M-1 X
20 L-2 O
21 L-3 X
FIRST FLOW
SECOND FLOW

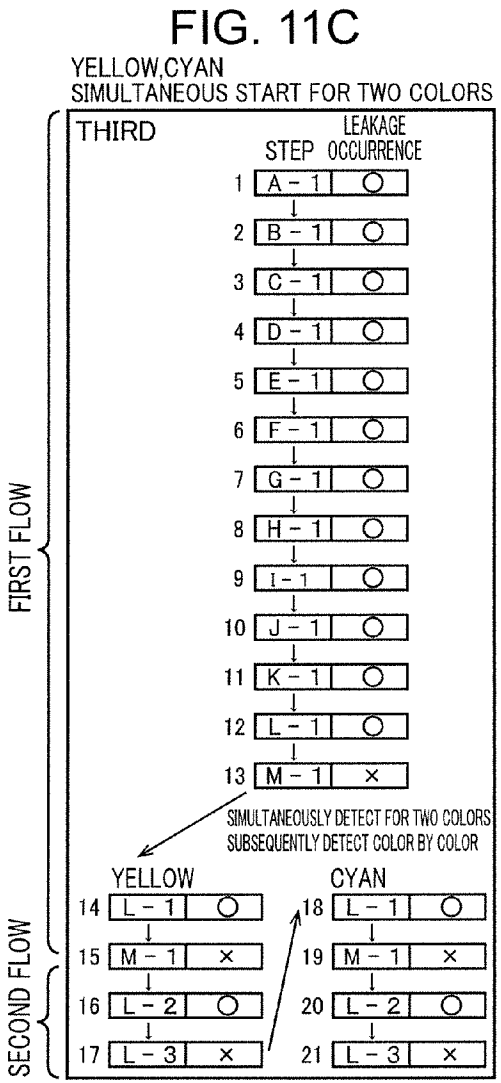
FIG. 11C
YELLOW,CYAN
SIMULTANEOUS START FOR TWO COLORS
THIRD
STEP
LEAKAGE OCCURRENCE
1 A-1 O
2 B-1 O
3 C-1 O
4 D-1 O
5 E-1 O
6 F-1 O
7 G-1 O
8 H-1 O
9 I-1 O
10 J-1 O
11 K-1 O
12 L-1 O
13 M-1 X
SIMULTANEOUSLY DETECT FOR TWO COLORS
SUBSEQUENTLY DETECT COLOR BY COLOR
YELLOW
14 L-1 O
15 M-1 X
16 L-2 O
17 L-3 X
CYAN
18 L-1 O
19 M-1 X
20 L-2 O
21 L-3 X
FIRST FLOW
SECOND FLOW

IMAGE FORMING APPARATUS WITH LEAKAGE DETECTING UNIT FOR DETECTING LEAKAGE

INCORPORATION BY REFERENCE

This application is based on Japanese Patent Applications No. 2014-052912 filed with the Japan Patent Office on Mar. 17, 2014 and No. 2014-210713 filed with the Japan Patent Office on Oct. 15, 2014, the contents of which are hereby incorporated by reference.

BACKGROUND

The present disclosure relates to an image forming apparatus provided with a plurality of developing devices.

An image forming apparatus adopting an electrophotographic method such as a copier, a printer or a facsimile machine forms a toner image on an image carrier (e.g. photoconductive drum or transfer belt) by supplying toner to an electrostatic latent image formed on the image carrier to develop the electrostatic latent image. A touch-down development method using a two-component developer containing nonmagnetic toner and magnetic carrier is known as one of methods for performing the above development. In this case, a two-component developer layer (so-called magnetic brush layer) is carried on a magnetic roller, the toner is transferred from the two-component developer layer onto a developing roller and a toner layer is carried on the developing roller. Further, the electrostatic latent image is visualized by the supply of the toner from the toner layer to the image carrier. Conventionally, there has been known a technology on a leakage detecting operation for detecting a leakage voltage, at which leakage occurs, by changing inter-peak voltages of alternating-current voltages in a developing device adopting the touch-down development method.

The technology of such a leakage detecting operation is applicable to a two-component development method. In the two-component development method, if inter-peak voltages of alternating-current voltages are set to be larger, toner becomes cloudy in a development area as in a nonmagnetic one-component development method and the touch-down development method. Thus, development performance is enhanced. Particularly, the two-component development method in which a magnetic brush made of a thin layer slightly comes into contact with an image carrier is useful since toner can be in a powder cloud state.

SUMMARY

An image forming apparatus according to one aspect of the present disclosure includes an image carrier, a developing device, a bias applying unit, a leakage detecting unit, a bias control unit and a leakage detection control unit. The image carrier has an electrostatic latent image formed on a surface and carries a toner image. The developing device includes a development housing, a magnetic roller and a developing roller. The development housing stores a developer containing toner to be charged to a predetermined polarity and carrier. The magnetic roller receives the developer in the development housing and carries a developer layer by being rotated. The developing roller receives the toner from the developer layer, carries a toner layer and supplies the toner to the image carrier by being rotated in a state in contact with the developer layer. The bias applying unit applies development biases, in which an alternating-current voltage is superimposed on a direct-current voltage, to the magnetic roller and the developing roller. The leakage detecting unit detects leakage occurring between the image carrier and the developing roller or leakage occurring between the developing roller and the magnetic roller. The bias control unit provides a predetermined potential difference between the magnetic roller and the developing roller so that the toner is transferred from the magnetic roller to the developing roller by controlling the bias applying unit during a developing operation in which the toner is supplied from the developing roller to the image carrier. The leakage detection control unit performs a leakage detecting operation of detecting a value of an inter-peak voltage, at which the leakage occurred, as a leakage causing voltage at a time different from that of the developing operation while increasing the inter-peak voltage of the alternating-current voltage of the development bias. Four or more of developing devices and four or more bias applying units are arranged in correspondence with different colors of toner. The leakage detection control unit simultaneously starts the leakage detecting operation for a plurality of developing devices and performs the leakage detecting operations of the developing devices, in which leakage simultaneously occurred, while switching the leakage detecting operations one by one if the leakage simultaneously occurs in a plurality of developing devices at an inter-peak voltage.

BRIEF DESCRIPTION OF THE DRAWINGS

FIG. 8 is a diagram showing steps of other leakage detecting operations to be compared with the leakage detecting operations according to the embodiment of the present disclosure, FIGS. 9A, 9B and 9C are diagrams showing steps of leakage detecting operations according to a first embodiment of the present disclosure, FIG. 10 is a diagram showing steps of other leakage detecting operations to be compared with the leakage detecting operations according to the embodiment of the present disclosure, FIGS. 11A, 11B and 11C are diagrams showing steps of leakage detecting operations according to the first embodiment of the present disclosure.

DETAILED DESCRIPTION

Hereinafter, embodiments of the present disclosure are described in detail based on the drawings. Note that the present disclosure can be applied to an image forming apparatus adopting an electrophotographic method such as a copier, a printer, a facsimile or a complex machine provided with these functions.

Figure 1:
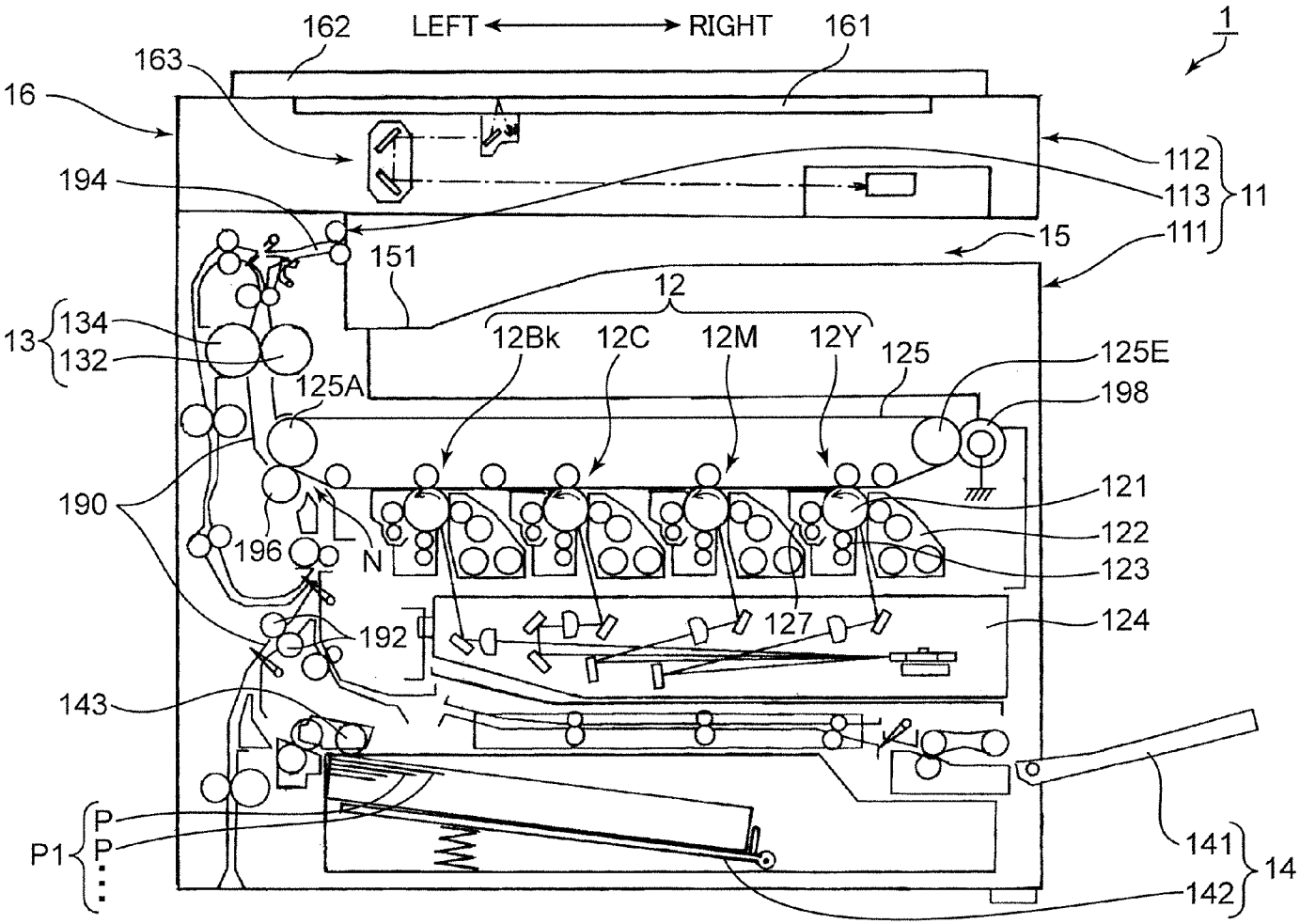
FIG. 1 is a sectional view showing an internal structure of an image forming apparatus according to an embodiment of the present disclosure.

FIG. 1 is a front view in section showing the structure of an image forming apparatus 1 according to one embodiment of the present disclosure. The image forming apparatus 1 includes an image forming station 12, a fixing device 13, a sheet feeding unit 14, a sheet discharging unit 15, a document reading unit 16 and the like in an apparatus main body 11.

The apparatus main body 11 includes a lower main body 111, an upper main body 112 arranged to face the lower main body 111 from above and a coupling portion 113 interposed between these upper and lower main bodies 112, 111. The coupling portion 113 is a structure for coupling the lower and upper main bodies 111, 112 to each other in a state where the sheet discharging unit 15 is formed between the both, and stands on a left part and a rear part of the lower main body 111 to be L-shaped in a plan view. The upper main body 112 is supported on an upper end part of the coupling portion 113.

The image forming station 12, the fixing device 13 and the sheet feeding unit 14 are housed in the lower main body 111 and the document reading unit 16 is housed in the upper main body 112.

The image forming station 12 performs an image forming operation of forming a toner image on a sheet P fed from the sheet feeding unit 14. The image forming station 12 includes a yellow unit 12Y, a magenta unit 12M, a cyan unit 12C and a black unit 12Bk respectively using toner of yellow, magenta, cyan and black colors successively arranged from an upstream side toward a downstream side in a horizontal direction, an intermediate transfer belt 125 stretched on a plurality of rollers in such a manner as to be able to endlessly travel in a sub scanning direction in image formation, a secondary transfer roller 196 held in contact with the outer peripheral surface of the intermediate transfer belt 125, and a belt cleaning device 198.

The unit of each color of the image forming station 12 integrally includes a photoconductive drum 121 (image carrier), a developing device 122 for supplying the toner to the photoconductive drum 121, a toner cartridge (not shown) containing the toner, a charging device 123 and a drum cleaning device 127. Further, an exposure device 124 for exposing each photoconductive drum 121 to light is horizontally arranged below the adjacent developing devices 122.

The photoconductive drum 121 has an electrostatic latent image formed on the circumferential surface thereof and carries a toner image obtained by developing the electrostatic latent image by the toner. In this embodiment, the photoconductive drum 121 is an amorphous silicon (α-Si) photoconductor.

The developing device 122 supplies the toner to an electrostatic latent image on the circumferential surface of the photoconductive drum 121 rotating in a direction of an arrow to form a layer of the toner, and forms a toner image corresponding to image data on the circumferential surface of the photoconductive drum 121. The toner is appropriately supplied to each developing device 122 from the toner cartridge.

Each charging device 123 is provided at a position right below the corresponding photoconductive drum 121. The charging device 123 uniformly charges the circumferential surface of each photoconductive drum 121.

The exposure device 124 is provided at a position below the respective charging devices 123. The exposure device 124 irradiates the charged circumferential surface of the photoconductive drum 121 with laser light corresponding to each color based on image data input from a computer or the like or image data obtained by the document reading unit 16, thereby forming an electrostatic latent image on the circumferential surface of each photoconductive drum 121. Note that the exposure device 124 irradiates the laser light according to an exposure light amount set in advance in order to form a predetermined latent image potential on the photoconductive drum 121. The drum cleaning device 127 is provided to the left of each photoconductive drum 121 and cleans the circumferential surface of the photoconductive drum 121 by removing the residual toner.

The intermediate transfer belt 125 is an endless, electrically conductive and soft belt having a laminated structure composed of a base layer, an elastic layer and a coating layer. The intermediate transfer belt 125 is mounted on a plurality of tension rollers arranged substantially in the horizontal direction above the image forming station 12. The tension rollers include a drive roller 125A arranged near the fixing device 13 to rotationally drive the intermediate transfer belt 125 and a driven roller 125E arranged at a predetermined distance from the drive roller 125A in the horizontal direction and configured to rotate, following the rotation of the intermediate transfer belt 125. The intermediate transfer belt 125 is driven to rotate in a clockwise direction in FIG. 1 by giving a rotational drive force to the drive roller 125A.

A secondary transfer bias applying unit (not shown) is electrically connected to the secondary transfer roller 196. A toner image formed on the intermediate transfer belt 125 is transferred to a sheet P conveyed from a pair of conveyor rollers 192 located below by a transfer bias applied between the secondary transfer roller 196 and the drive roller 125A. The belt cleaning device 198 is arranged to face the driven roller 125E via the intermediate transfer belt 125 at an outer side of the driven roller 125E.

The fixing device 13 includes a heating roller 132 and a pressure roller 134 arranged to face the heating roller 132. The fixing device 13 applies a fixing process to a toner image on a sheet P transferred in the image forming station 12 by giving heat from the heating roller 132 while the sheet P is passing through a fixing nip portion between the heating roller 132 and the pressure roller 134. The color-printed sheet P completed with the fixing process is discharged toward a sheet discharge tray 151 provided on the top of the apparatus main body 11 through a sheet discharge conveyance path 194 extending from an upper part of the fixing device 13.

The sheet feeding unit 14 includes a manual feed tray 141 openably and closably provided on a right side wall of the apparatus main body 11 in FIG. 1 and a sheet cassette 142 insertably mounted at a position below the exposure device 124 in the apparatus main body 11. The sheet cassette 142 stores a sheet stack P1 formed by stacking a plurality of sheets P. A pickup roller 143 is provided above the sheet cassette 142 and feeds the uppermost sheet P of the sheet stack P1 stored in the sheet cassette 142 to a sheet conveyance path 190. The manual feed tray 141 is a tray provided at a lower position on the right surface of the lower main body 111 for manually feeding sheets P one by one toward the image forming station 12.

The vertically extending sheet conveyance path 190 is formed to the left of the image forming station 12. The pair of conveyor rollers 192 are provided at a suitable position in the sheet conveyance path 190 and conveys a sheet P fed from the sheet feeding unit 14 toward a secondary transfer nip portion including the secondary transfer roller 196.

The sheet discharging unit 15 is formed between the lower and upper main bodies 111, 112. The sheet discharging unit 15 includes the sheet discharge tray 151 formed on the upper surface of the lower main body 111. The sheet discharge tray 151 is a tray onto which a sheet P having a toner image formed in the image forming station 12 is discharged after a fixing process is applied thereto in the fixing device 13.

The document reading unit 16 includes a contact glass 161 which is mounted in an upper surface opening of the upper main body 112 and on which a document is to be placed, a document pressing cover 162 which is free to open and close and presses a document and a scanning mechanism 163 which scans and reads an image of a document. The scanning mechanism 163 optically reads an image of a document using an image sensor such as a CCD (Charge Coupled Device) or a CMOS (Complementary Metal Oxide Semiconductor) and generates image data. Further, the apparatus main body 11 includes an image processing unit (not shown) for generating an image from this image data.

<Configuration of the Developing Device>

Figure 2:
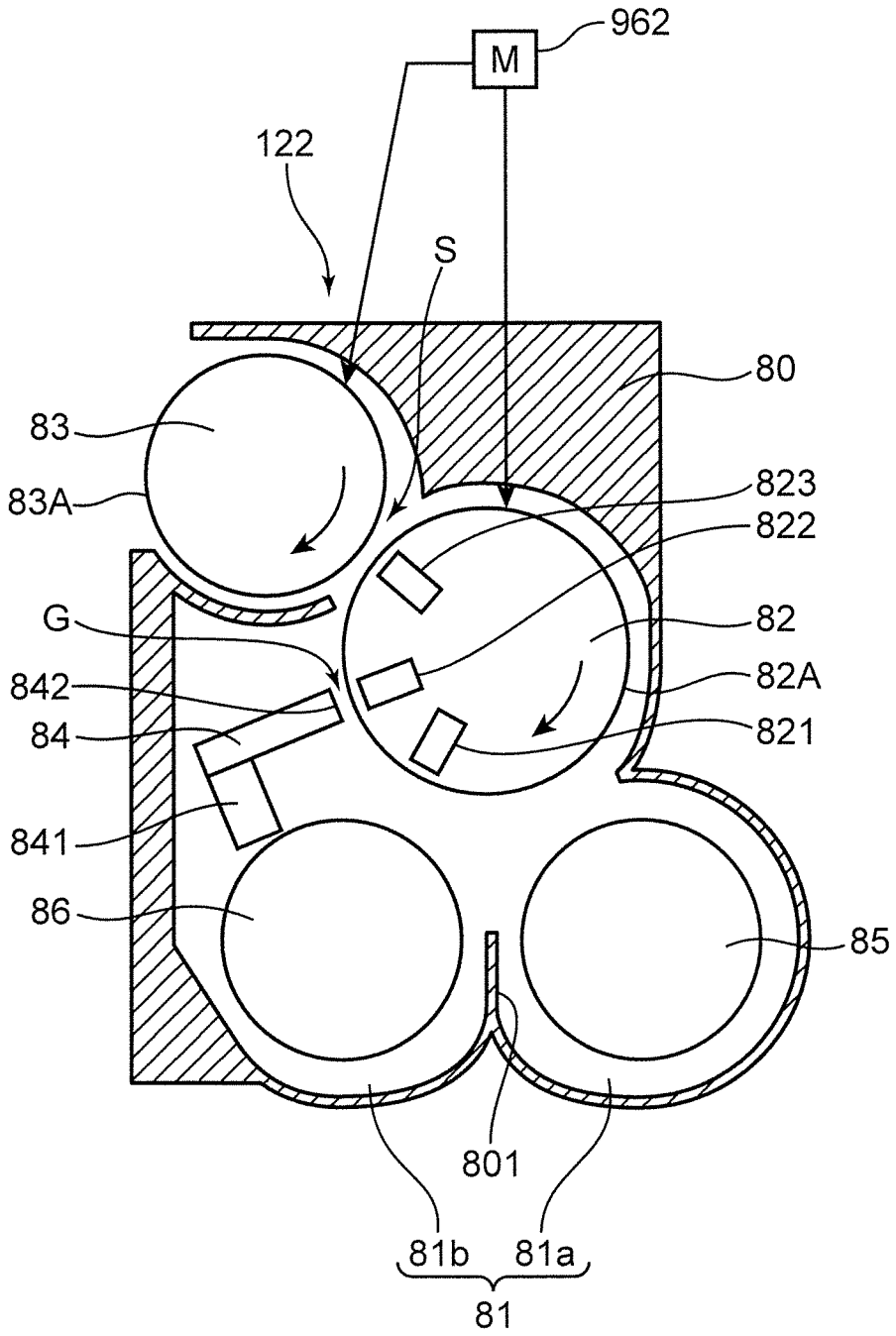
FIG. 2 is a sectional view of a developing device according to the embodiment of the present disclosure.
Figure 3:
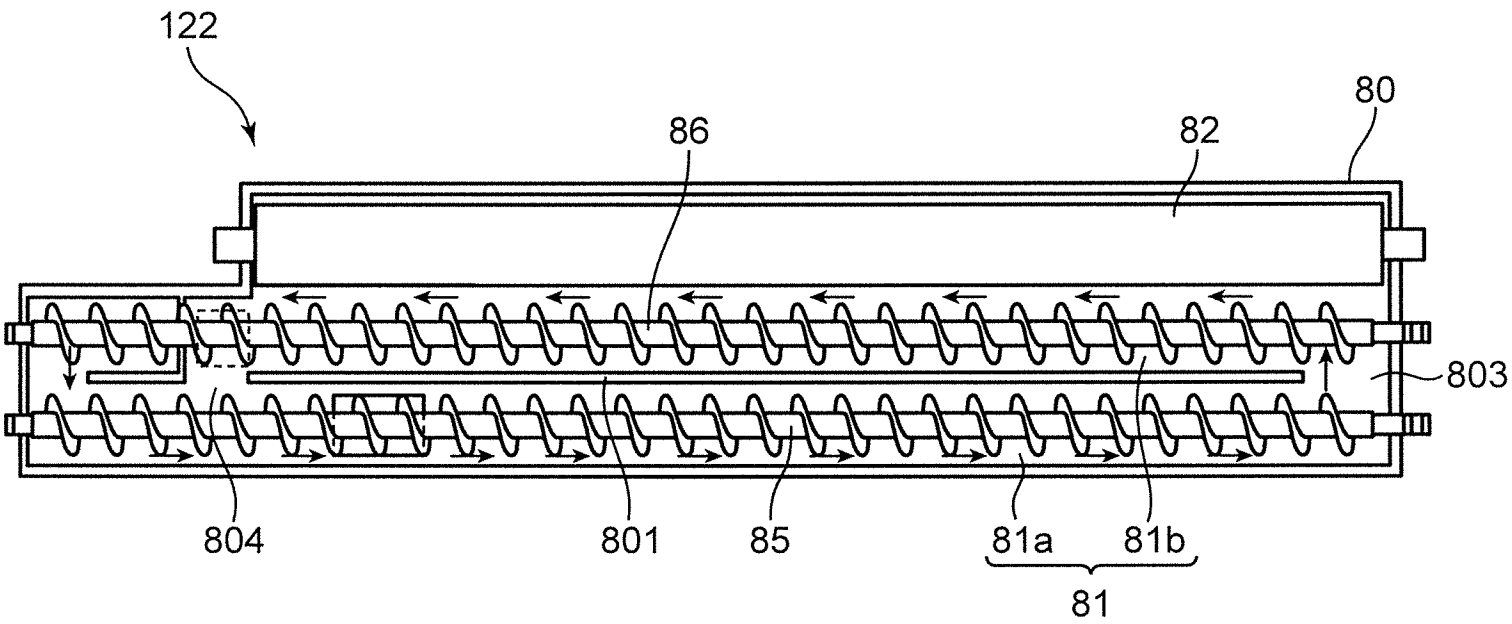
FIG. 3 is a plan view showing an internal structure of the developing device according to the embodiment of the present disclosure.

Next, the developing device 122 is described in detail. FIG. 2 is a vertical and lateral sectional view schematically showing an internal structure of the developing device 122, and FIG. 3 is a plan view showing the internal structure of the developing device 122. The developing device 122 includes a development housing 80 defining an internal space of the developing device 122. This development housing 80 includes a developer storage 81 for storing a developer containing nonmagnetic toner to be charged to a predetermined polarity and magnetic carrier. An average particle diameter of the toner is 6.8 μm. Further, a magnetic roller 82 arranged above the developer storage 81, a developing roller 83 arranged to face the magnetic roller 82 at a position obliquely above the magnetic roller 82 and a developer regulation blade 84 arranged to face the magnetic roller 82 are arranged in the development housing 80.

The developer storage 81 includes two adjacent developer storage chamber 81*a*, 81*b* extending in a longitudinal direction of the developing device 122. The developer storage chamber 81*a*, 81*b* are integrally formed to the development housing 80 and partitioned by a partition plate 801 extending in the longitudinal direction, but communicate with each other through communication paths 803, 804 at opposite end parts in the longitudinal direction as shown in FIG. 3. Screw feeders 85, 86 for agitating and conveying the developer by rotating about their axes are housed in the respective developer storage chamber 81*a*, 81*b*. The screw feeders 85, 86 are rotationally driven by an unillustrated driving mechanism, and rotating directions thereof are set to be opposite to each other. In this way, the developer is conveyed in a circulating manner between the developer storage chamber 81*a*, 81*b* while being agitated as shown in FIG. 3. By this agitation, the toner and the carrier are mixed and the toner is, for example, positively charged.

The magnetic roller 82 is arranged along the longitudinal direction of the developing device 122 and rotationally driven in a clockwise direction in FIG. 2. A fixed so-called magnet roll (not shown) is arranged in the magnetic roller 82. The magnet roll includes a plurality of poles, in this embodiment, a draw-up pole 821, a regulating pole 822 and a main pole 823. The draw-up pole 821 faces the developer storage 81, the regulating pole 822 faces the developer regulation blade 84 and the main pole 823 faces the developing roller 83. Further, the magnetic roller 82 is rotated in a direction opposite to the developing roller 83 (counter direction) at a facing position at a circumferential speed which is 1.5 times as fast as that of the developing roller 83.

The magnetic roller 82 magnetically draws up (receives) the developer onto a circumferential surface 82A thereof from the developer storage 81 by a magnetic force of the draw-up pole 821. The magnetic roller 82 magnetically carries the drawn-up developer as a developer layer (magnetic brush layer) on the circumferential surface 82A. With the rotation of the magnetic roller 82, the developer is conveyed toward the developer regulation blade 84.

The developer regulation blade 84 is arranged upstream of the developing roller 83 when viewed in a rotating direction of the magnetic roller 82 and regulates a layer thickness of the developer layer magnetically adhering to the circumferential surface 82A of the magnetic roller 82. The developer regulation blade 84 is a plate member made of a magnetic material and extending along a longitudinal direction of the magnetic roller 82 and supported by a predetermined supporting member 841 fixed at a suitable position of the development housing 80. Further, the developer regulation blade 84 has a regulation surface 842 (i.e. tip surface of the developer regulation blade 84) for forming a regulation gap G of a predetermined dimension between the regulation surface 842 and the circumferential surface 82A of the magnetic roller 82.

The developer regulation blade 84 formed of the magnetic material is magnetized by the regulating pole 822 of the magnetic roller 82. In this way, a magnetic path is formed between the regulation surface 842 of the developer regulation blade 84 and the regulating pole 822, i.e. in the regulation gap G. When the developer layer adhering to the circumferential surface 82A of the magnetic roller 82 by the draw-up pole 821 is conveyed into the regulation gap G with the rotation of the magnetic roller 82, the layer thickness of the developer layer is regulated in the regulation gap G. In this way, the uniform developer layer having a predetermined thickness is formed on the circumferential surface 82A.

The developing roller 83 is arranged to extend along the longitudinal direction of the developing device 122 and in parallel to the magnetic roller 82 and rotationally driven in a clockwise direction in FIG. 2. The developing roller 83 has a circumferential surface 83A for carrying a toner layer by receiving the toner from the developer layer while rotating in a state in contact with the developer layer held on the circumferential surface 82A of the magnetic roller 82. At the time of development in which a developing operation is performed, the developing roller 83 supplies the toner of the toner layer to the circumferential surface of the photoconductive drum 121. In this embodiment, the developing roller 83 is a roller formed by applying resin coating (urethane coating) to an alumite surface. Further, the developing roller 83 is rotated in the same direction as the photoconductive drum 121 (with rotation) at a facing position at a circumferential speed which is 1.3 times as fast as that of the photoconductive drum 121.

The developing roller 83 and the magnetic roller 82 are rotationally driven by a driving unit 962 to be described later. A clearance S of a predetermined dimension is formed between the circumferential surface 83A of the developing roller 83 and the circumferential surface 82A of the magnetic roller 82. The clearance S is, for example, set at 0.3 mm. The developing roller 83 is arranged to face the photoconductive drum 121 through an opening formed on the development housing 80 and a clearance of a predetermined dimension is also formed between the circumferential surface 83A and the circumferential surface of the photoconductive drum 121. In this embodiment, this clearance is set at 0.12 mm.

<Electrical Configuration, Block Diagram>

Figure 4:
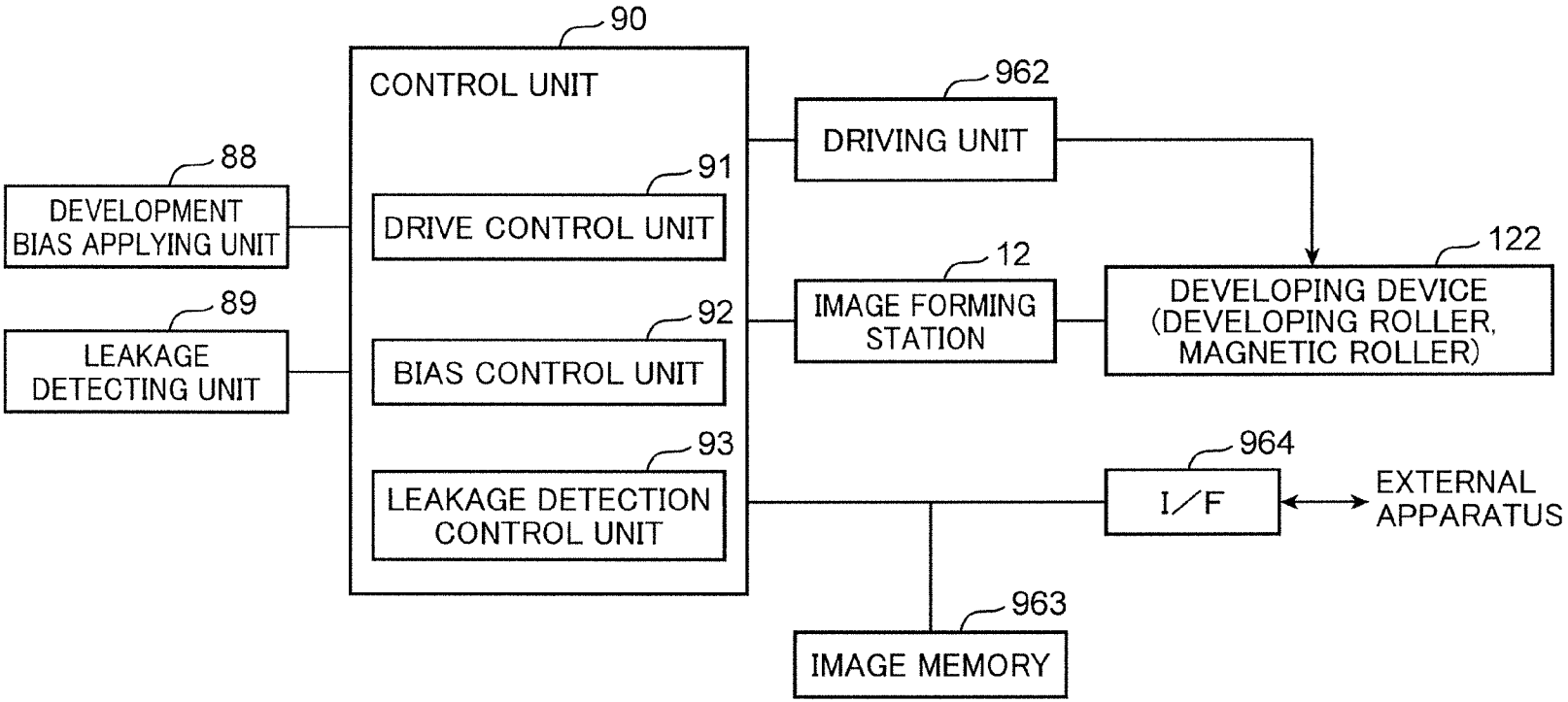
FIG. 4 is a block diagram showing an electrical configuration of a control unit according to the embodiment of the present disclosure.
Figure 5:
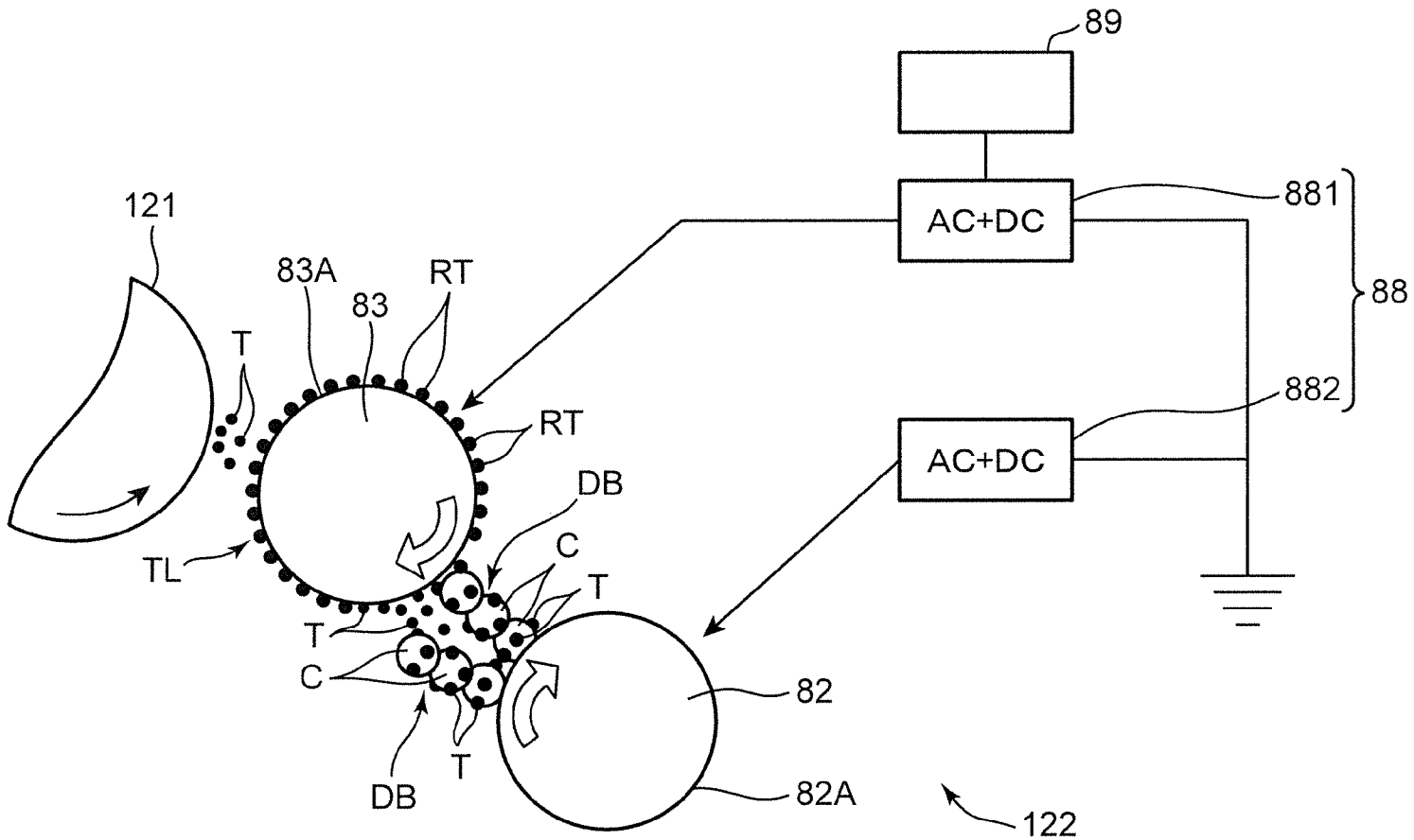
FIG. 5 is a diagram showing a developing operation of the developing device according to the embodiment of the present disclosure.

Next, a main electrical configuration of the image forming apparatus 1 is described. The image forming apparatus 1 (developing device 122) includes a control unit 90 for comprehensively controlling the operation of each component of the image forming apparatus 1. FIG. 4 is a functional block diagram of the control unit 90. FIG. 5 is a diagram showing the developing operation of the developing device 122 according to this embodiment. The control unit 90 is composed of a CPU (Central Processing Unit), a ROM (Read Only Memory) storing a control program, a RAM (Random Access Memory) used as a work area of the CPU and the like. Further, a development bias applying unit 88, a leakage detecting unit 89, the driving unit 962, an image memory 963, an I/F 964 and the like are electrically connected to the control unit 90 in addition to each member of the developing device 122.

With reference to FIG. 5, the development bias applying unit 88 is composed of a first applying unit 881 and a second applying unit 882. These applying units are each composed of a direct-current power supply and an alternating-current power supply and apply development biases, in which an alternating-current voltage is superimposed on a direct-current voltage, to the magnetic roller 82 and the developing roller 83 in the developing device 122 based on a control signal from a bias control unit 92 or a leakage detection control unit 93 to be described later. In this embodiment, the first applying unit 881 is electrically connected to the developing roller 83. Further, the second applying unit 882 is electrically connected to the magnetic roller 82. As shown in FIG. 5, a voltage applied to the developing roller 83 is set on the basis of ground and a voltage applied to the magnetic roller 82 is set on the basis of a potential of the developing roller 83.

The leakage detecting unit 89 is electrically connected to the development bias applying unit 88. The leakage detecting unit detects leakage occurring between the photoconductive drum 121 and the developing roller 83 or between the developing roller 83 and the magnetic roller 82. Specifically, the leakage detecting unit 89 detects leakage based on a variation of the value of a current (overcurrent) flowing in the developing roller 83.

Figure 6:
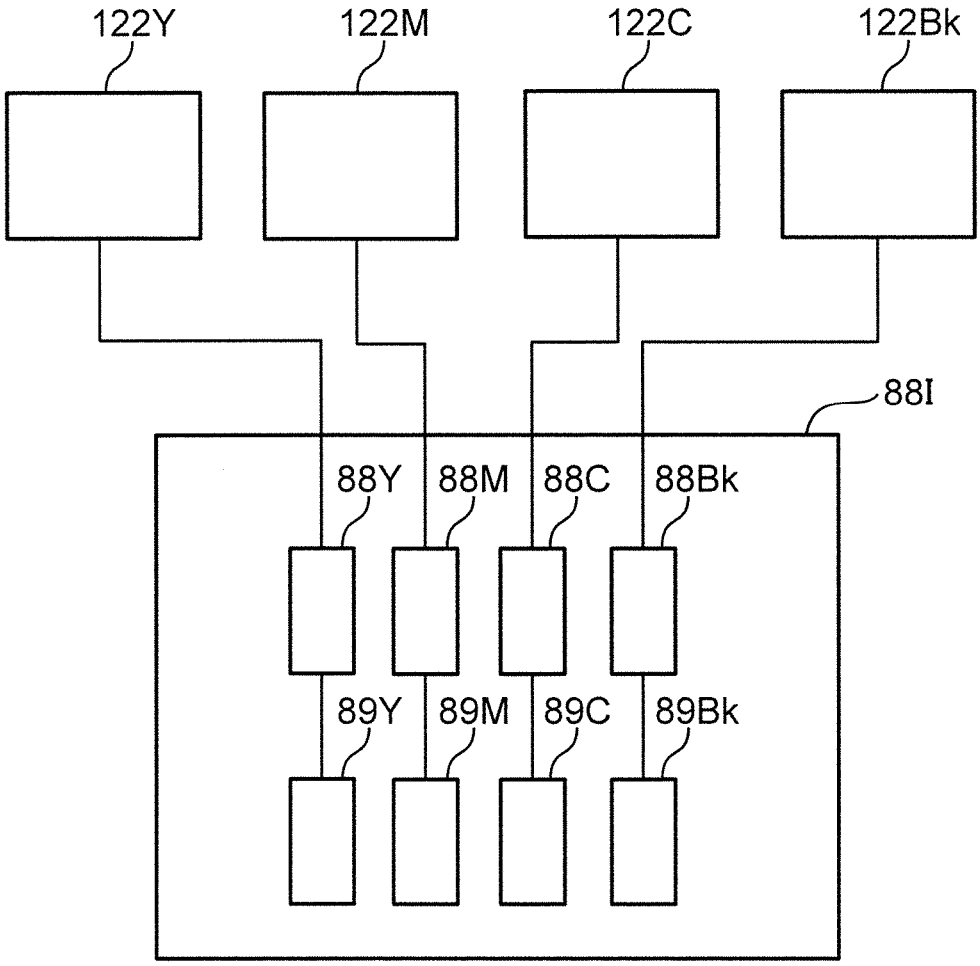
FIG. 6 is a diagram showing a plurality of developing devices and a plurality of bias applying units according to the embodiment of the present disclosure.

FIG. 6 is a diagram of the developing devices 122, the development bias applying units 88 and the leakage detecting units 89 mounted in the image forming apparatus 1. FIG. 6 is equivalent to a view of the image forming apparatus 1 viewed from behind. As shown in FIG. 6, individual development bias applying units 88 (88Y, 88M, 88C and 88Bk) are electrically connected to the developing devices 122 (122Y, 122M, 122C and 122Bk) of the respective colors. Further, the leakage detecting units 89 (89Y, 89M, 89C and 89Bk) are connected to the development bias applying units 88 of the respective colors. All the development bias applying units 88 and leakage detecting units 89 are mounted on one substrate 881. At this time, the respective development bias applying units 88 are adjacently arranged along one direction (from left to right in the figure plane).

The driving unit 962 (FIG. 4) is composed of a motor and a gear mechanism for transmitting a torque of the motor and rotationally drives the developing roller 83, the magnetic roller 82 and the screw feeders 85, 86 in the developing device 122 in addition to the photoconductive drum 121 during a developing operation and a leakage detecting operation in accordance with a control signal from the control unit 90. In this embodiment, the developing roller 83, the magnetic roller 82 and the screw feeders 85, 86 are rotationally driven in synchronization by the driving unit 962.

The image memory 963 temporarily stores image data to be printed given from an external apparatus such as a personal computer when this image forming apparatus 1 functions as a printer. Further, the image memory 963 temporarily stores image data optically read by an ADF (Auto Document Feeder) when the image forming apparatus 1 functions as a copier.

The I/F 964 is an interface circuit for realizing data communication with external apparatuses and, for example, generates a communication signal conforming to a communication protocol of a network connecting the image forming apparatus 1 and the external apparatuses and converts a communication signal from a network side into data of a format processable by the image forming apparatus 1. A print instruction signal transmitted from a personal computer or the like is given to the control unit 90 via the I/F 964 and image data is stored in the image memory 963 via the I/F 964.

The control unit 90 functions to include a drive control unit 91, the bias control unit 92 and the leakage detection control unit 93 by the CPU executing the control program stored in the ROM.

The drive control unit 91 rotationally drives the developing roller 83, the magnetic roller 82 and the screw feeders 85, 86 by controlling the driving unit 962. Further, the drive control unit 91 rotationally drives the photoconductive drum 121 by controlling an unillustrated drive mechanism. In this embodiment, the drive control unit 91 rotationally drives each of the above members in a developing operation and a leakage detecting operation.

The bias control unit 92 provides potential differences of a direct-current voltage and an alternating-current voltage between the magnetic roller 82 and the developing roller 83 by controlling the development bias applying unit 88 during the developing operation in which the toner is supplied from the magnetic roller 82 to the developing roller 83 and further from the developing roller 83 to the photoconductive drum 121. The toner is transferred from the magnetic roller 82 to the developing roller 83 by the above potential differences. The development biases during the developing operation are described in detail later.

The leakage detection control unit 93 applies direct-current voltages and alternating-current voltages to the magnetic roller 82 and the developing roller 83 by controlling the development bias applying unit 88 during the leakage detecting operation. In the leakage detecting operation, an inter-peak voltage (leakage causing voltage) of the alternating-current voltage at which leakage occurs is detected out of the development bias applied to the developing roller 83. At this time, the leakage detection control unit 93 causes leakage to occur between the photoconductive drum 121 and the developing roller 83 or between the magnetic roller 82 and the developing roller 83 while increasing the inter-peak voltage of the alternating-current voltage of the development bias. The leakage detecting operation is performed prior to the developing operation, i.e. at a time different from that of the developing operation. As a result, the occurrence of leakage is prevented by subtracting a predetermined offset voltage from the leakage causing voltage and setting the inter-peak voltage of the alternating-current voltage in a range not reaching the leakage causing voltage. Note that the development biases during the leakage detecting operation are described in detail later.

<Concerning the Developing Operation>

Next, a development mechanism of an electrostatic latent image on the photoconductive drum 121 in the developing operation is described with reference to FIG. 5. The image forming apparatus 1 according to this embodiment has, for example, a print speed of 40 pages/min. The circumference speed of the photoconductive drum 121 is set at 210 mm/sec. Further, in this embodiment, coating ferrite carrier having a volume specific resistance of $10^{10}$ Ω·m, a saturation magnetization of 65 emu/g and an average particle diameter of 35 μm is used as the carrier in the developer.

A magnetic brush layer on the circumferential surface 82A of the magnetic roller 82 is conveyed toward the developing roller 83 with the rotation of the magnetic roller 82 after a layer thickness thereof is uniformly regulated by the developer regulation blade 84. Thereafter, a multitude of magnetic bristles DB in the magnetic brush layer come into contact with the circumferential surface 83A of the developing roller 83 in rotation in an area where the magnetic roller 82 and the developing roller 83 face each other.

At this time, the bias control unit 92 applies development biases, each composed of a direct-current voltage and an alternating-current voltage, to the magnetic roller 82 and the developing roller 83 as described later by controlling the development bias applying unit 88. This causes a predetermined potential difference (development potential difference ΔV) between the circumferential surface 82A of the magnetic roller 82 and the circumferential surface 83A of the developing roller 83. The development potential difference ΔV is set in a range of 100 V to 350 V depending on an environment and the like. Due to this potential difference, only toner particles T are transferred from the magnetic bristles DB to the circumferential surface 83A at the facing position of the circumferential surfaces 82A and 83A (facing position of the main pole 823 (FIG. 2) and the circumferential surface 83A) and the carrier particles C and the remaining toner particles of the magnetic bristles DB remain on the circumferential surface 82A. In this way, a toner layer TL having a predetermined thickness is carried on the circumferential surface 83A of the developing roller 83.

The toner layer TL on the circumferential surface 83A is conveyed toward the circumferential surface of the photoconductive drum 121 with the rotation of the developing roller 83. A superimposed voltage of a direct-current voltage and an alternating-current voltage is applied to the developing roller 83. Thus, a predetermined potential difference is generated between the circumferential surface of the photoconductive drum 121 having a potential on the surface according to the electrostatic latent image and the circumferential surface 83A of the developing roller 83. Due to this potential difference, the toner particles T of the toner layer TL are transferred to the circumferential surface of the photoconductive drum 121. In this way, the electrostatic latent image on the circumferential surface of the photoconductive drum 121 is developed to form a toner image.

Note that examples of the development biases applied to the magnetic roller 82 and the developing roller 83 by controlling the development bias applying unit 88 during the developing operation by the bias control unit 92 are as follows.

Direct-current voltage $V_{mag_dc}$ of the magnetic roller 82; 300 V

Direct-current voltage $V_{slv_dc}$ of the developing roller 83; 50 V

Alternating-current voltage ($V_{pp}$) $V_{mag_ac}$ between the developing roller 83 and the magnetic roller 82; 1800 V (4.7 kHz)

Alternating-current voltage ($V_{pp}$) $V_{slv_ac}$ of the developing roller 83; 1300 V (4.7 kHz)

Duty ratio (Duty 1) of the alternating-current voltage of the developing roller 83; 45%

Duty ratio (Duty 2) of the alternating-current voltage between the developing roller 83 and the magnetic roller 82; 70%

Image part potential VL of the photoconductive drum 121: +20 V

Background part potential Vo of the photoconductive drum 121; +230 V

As described above, the alternating-current voltages of the development biases are also applied to the magnetic roller 82 and the developing roller 83 during the developing operation. Thus, a cyclic potential difference based on the alternating-current voltages is set between the magnetic roller 82 and the developing roller 83 in addition to the aforementioned development potential difference ΔV composed of the direct-current voltage. As a result, the transfer of the toner from the magnetic roller 82 to the developing roller 83 is promoted.

Further, in such a developing device 122, development biases specific to the magnetic roller 82 and the developing roller 83 can be applied when the leakage causing voltage at which leakage occurs between the photoconductive drum 121 and the developing roller 83 or between the magnetic roller 82 and the developing roller 83 is detected by the leakage detecting unit 89. Thus, it is possible to suppress the transfer of the toner from the magnetic roller 82 to the developing roller 83 during the leakage detecting operation and perform the leakage detecting operation in a state where the surface of the developing roller 83 is maximally exposed.

The leakage detection control unit 93 (FIG. 4) performs the leakage detecting operation such as when the image forming apparatus 1 is shipped from a factory or when the developing device 122 or the photoconductive drum 121 is exchanged in the image forming apparatus 1. The leakage detection control unit 93 also performs the leakage detecting operation such as when an environment (temperature, humidity) around the image forming apparatus 1 is changed or when a predetermined number of printing operations have been performed. In such a leakage detecting operation, the leakage detection control unit 93 rotationally drives the photoconductive drum 121 and each member of the developing device 122 by controlling the drive control unit 91. Further, the leakage detection control unit 93 forms an electrostatic latent image on the photoconductive drum 121 by controlling the charging device 123 and the exposure device 124. Then, the leakage detection control unit 93 detects an inter-peak voltage, at which leakage occurs, by detecting an overcurrent by the leakage detecting unit 89 while increasing the inter-peak voltage(s) of the alternating-current voltage(s) applied only to the developing roller 83 or to the developing roller 83 and the magnetic roller 82. Note that if two transformers are connected to each of the developing roller 83 and the magnetic roller 82 in each developing device 122 like in this embodiment, the leakage detection control unit 93 performs the leakage detecting operation in a state where the alternating-current voltage applied to the developing roller 83 is changed and the alternating-current voltage between the developing roller 83 and the magnetic roller 82 is fixed. On the other hand, in another embodiment, development biases may be applied to the developing roller 83 and the magnetic roller 82 from one transformer. In this case, alternating-current voltages having phases opposite to each other are applied to the developing roller 83 and the magnetic roller 82 during the developing operation. During the leakage detecting operation, the leakage detection control unit 93 performs the leakage detecting operation while changing the alternating-current voltages applied to both the developing roller 83 and the magnetic roller 82.

Examples of the development biases applied to the magnetic roller 82 and the developing roller 83 by controlling the development bias applying unit 88 during the leakage detecting operation by the development bias applying unit 93 are as follows.

Direct-current voltage $V_{mag_dc}$ of the magnetic roller 82; 50 V

Direct-current voltage $V_{slv_dc}$ of the developing roller 83; 30 V

Alternating-current voltage ($V_{pp}$) $V_{mag_ac}$ between the developing roller 83 and the magnetic roller 82; 50 V (fixed) (3.0 kHz)

Alternating-current voltage ($V_{pp}$) $V_{slv_ac}$ of the developing roller 83; variable (3.0 kHz)

Duty ratio of the alternating-current voltage of the developing roller 83; 35%

Duty ratio of the alternating-current voltage between the developing roller 83 and the magnetic roller 82; 35%

Image part potential VL of the photoconductive drum 121: +20 V

Background part potential Vo of the photoconductive drum 121; +230 V

In the leakage detecting operation, the direct-current voltage Vmag_dc of the magnetic roller 82 is set to be smaller than during the developing operation and the alternating-current voltage between the developing roller 83 and the magnetic roller 82 is reduced to suppress the transfer of the toner from the magnetic roller 82 to the developing roller 83.

Next, a leakage detecting operation according to a first embodiment of the present disclosure is further described. TABLE 1 is a table of the inter-peak voltage Vpp of the development bias according to this embodiment. TABLE 1 is stored in an unillustrated storage connected to the control unit 90. TABLE 1 is referred to by the leakage detection control unit 93 in performing the leakage detecting operation. Values of different inter-peak voltages from column 1 to column 5 are stored in each of row A to row V of TABLE 1 in advance.

TABLE 1

| | Developing Roller Inter-Peak Voltage ($V_{pp}$: V) | | | | |
|---|---|---|---|---|---|
| | Inter-Peak Voltage 1 | Inter-Peak Voltage 2 | Inter-Peak Voltage 3 | Inter-Peak Voltage 4 | Inter-Peak Voltage 5 |
| A | 800 | 810 | 820 | 830 | 840 |
| B | 850 | 860 | 870 | 880 | 890 |
| C | 900 | 910 | 920 | 930 | 940 |
| D | 950 | 960 | 970 | 980 | 990 |
| E | 1000 | 1010 | 1020 | 1030 | 1040 |
| F | 1050 | 1060 | 1070 | 1080 | 1090 |
| G | 1100 | 1110 | 1120 | 1130 | 1140 |
| H | 1150 | 1160 | 1170 | 1180 | 1190 |
| I | 1200 | 1210 | 1220 | 1230 | 1240 |
| J | 1250 | 1260 | 1270 | 1280 | 1290 |
| K | 1300 | 1310 | 1320 | 1330 | 1340 |
| L | 1350 | 1360 | 1370 | 1380 | 1390 |

TABLE 1-continued

| | Developing Roller Inter-Peak Voltage ($V_{pp}$: V) | | | | |
|---|---|---|---|---|---|
| | Inter-Peak Voltage 1 | Inter-Peak Voltage 2 | Inter-Peak Voltage 3 | Inter-Peak Voltage 4 | Inter-Peak Voltage 5 |
| M | 1400 | 1410 | 1420 | 1430 | 1440 |
| N | 1450 | 1460 | 1470 | 1480 | 1490 |
| O | 1500 | 1510 | 1520 | 1530 | 1540 |
| P | 1550 | 1560 | 1570 | 1580 | 1590 |
| Q | 1600 | 1610 | 1620 | 1630 | 1640 |
| R | 1650 | 1660 | 1670 | 1680 | 1690 |
| S | 1700 | 1710 | 1720 | 1730 | 1740 |
| T | 1750 | 1760 | 1770 | 1780 | 1790 |
| U | 1800 | 1810 | 1820 | 1830 | 1840 |
| V | 1850 | 1860 | 1870 | 1880 | 1890 |

Figure 7:
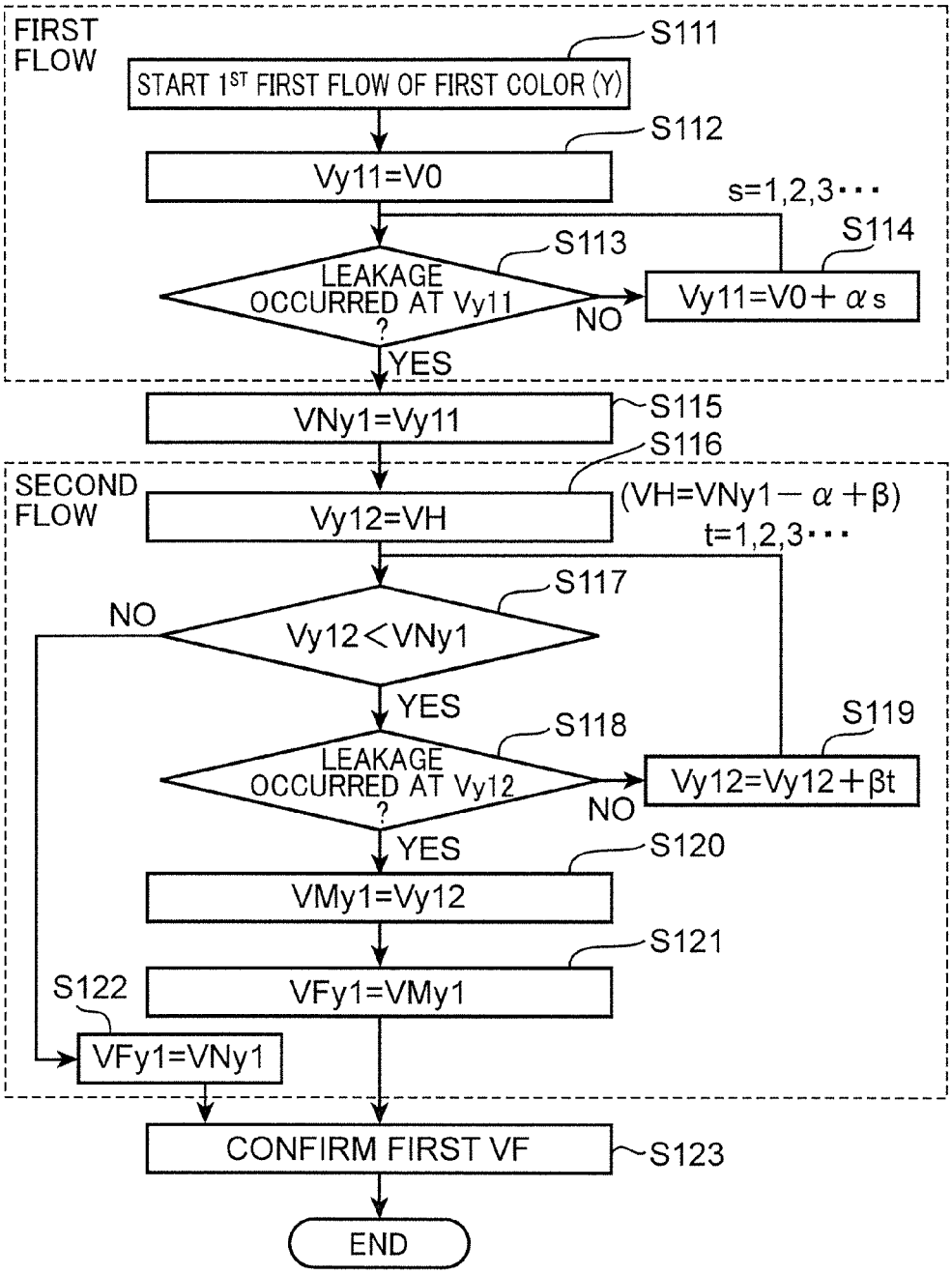
FIG. 7 is a flow chart of a leakage detecting operation according to the embodiment of the present disclosure.

Further, FIG. 7 is a flow chart showing the leakage detecting operation according to this embodiment.

The leakage detection control unit 93 consecutively performs a plurality of leakage detecting operations at predetermined timings as described above. The plurality of leakage detecting operations in this embodiment include leakage detecting operations repeatedly performed for the same developing device and those successively performed for different developing devices.

In this embodiment, the leakage detection control unit 93 increases the inter-peak voltage from a reference detection start voltage V0 set in advance and finally detects the inter-peak voltage when leakage is detected as a leakage causing voltage VF.

With reference to FIG. 7, flows of the first leakage detecting operation in the developing device 122 of yellow are described in detail as an example. The leakage detection control unit 93 performs a first flow (rough adjusting operation) having relatively rough detection accuracy and performed in a short time and a second flow (fine adjusting operation) having high detection accuracy. The leakage detection control unit 93 refers to an inter-peak voltage of 800 V in row A, column 1 shown in TABLE 1 (hereinafter, A-1 of TABLE 1) and starts the leakage detecting operation from Vy11=800 V (Step S112 of FIG. 7) when starting the leakage detecting operation of the developing device 122 of yellow (Step S111 of FIG. 7). Note that the inter-peak voltage of A-1 of TABLE 1 is defined as the reference detection start voltage V0. The reference detection start voltage V0 is a minimum value of the inter-peak voltage shown in TABLE 1 and set at a value, which is about half the inter-peak voltage at which leakage averagely occurs at the developing roller 83 when the image forming apparatus 1 is installed on a standard flat land (not high land), in advance. Note that, by setting the reference detection start voltage V0 to be relatively low in this way, the leakage detecting operation is stably performed even if the image forming apparatus 1 is installed on a high land and leakage easily occurs due to low air pressure. Note that, out of a symbol of the inter-peak voltage Vy11 shown in FIG. 7, "y" denotes yellow, the following "1" means the first leakage detecting operation of yellow and the further following "1" means the first flow until a first leakage causing voltage VN to be described later is derived. The same holds true for symbols described below.

The leakage detection control unit 93 applies the inter-peak voltage Vy11 to the developing roller 83 and causes the leakage detecting unit 89 to detect the occurrence of leakage (Step S113 of FIG. 7). If no leakage has occurred (NO in Step S113), the leakage detection control unit 93 sets a value obtained by adding α×s to the reference detection start voltage V0 as a new inter-peak voltage Vy11 (Step S114). Here, a is a first potential interval set in advance and set at 50 V in this embodiment. Note that s is a natural number and counted up by one every time Step S114 is repeated. The leakage detection control unit 93 repeats Steps S113 and S114 while increasing s until leakage occurs at the updated inter-peak voltage Vy11.

When leakage occurs at the inter-peak voltage Vy11 (YES in S113), the leakage detection control unit 93 stores the inter-peak voltage Vy11 at that time as the first leakage causing voltage VN in the storage (Step S115). Note that the first leakage causing voltage VN is denoted by VNy1 (first leakage causing voltage VN in the first leakage detecting operation of yellow) in FIG. 7. For example, if Steps S113 and S114 of FIG. 7 are repeated twelve times, the first leakage causing voltage VNy1=800+50×12=1400 V (see M-1 of TABLE 1).

As just described, in this embodiment, the leakage detection control unit 93 increases the inter-peak voltage at the first potential interval α from the reference detection start voltage V0 and detects the inter-peak voltage at which leakage was first detected as the first leakage causing voltage VN as the first flow of the leakage detecting operation.

Further, with reference to FIG. 7, the leakage detection control unit 93 adopts a supplementary detection start voltage VH as a first inter-peak voltage Vy12 of the second flow (Step S116). Note that, out of a symbol of the inter-peak voltage Vy12 shown in FIG. 7, "y" denotes yellow, the following "1" means the first leakage detecting operation of yellow and the further following "2" means the second flow until a second leakage causing voltage VM to be described later is derived. The same holds true for symbols described below. Here, the supplementary detection start voltage VH is calculated as VH=VNy1−α+β. Note that β is a second potential interval set in advance and set at 10 V in this embodiment. Thus, the supplementary detection start voltage VH is: VH=1400-50+10=1360 V (see L-2 of TABLE 1).

Subsequently, the leakage detection control unit 93 determines whether the first inter-peak voltage Vy12 adopting the supplementary detection start voltage VH is smaller than the aforementioned first leakage causing voltage VNy1 (Step S117). Since Vy12<VNy1 holds (YES in Step S117) at the start of the second flow, the leakage detection control unit 93 causes the leakage detecting unit 89 to detect whether leakage occurs at this inter-peak voltage Vy12 (Step S118). If no leakage occurs (NO in Step S118), the leakage detection control unit 93 sets a value obtained by adding β×t to the inter-peak voltage Vy12 as a new inter-peak voltage Vy12 (Step S119). Note that t is a natural number similarly to s and counted up by one every time Step S119 is repeated.

The leakage detection control unit 93 repeats Steps S117, S118 and S119 while increasing t until leakage occurs at the updated inter-peak voltage Vy12. When leakage occurs at the inter-peak voltage Vy12 (YES in Step S118), the leakage detection control unit 93 stores the inter-peak voltage Vy12 at that time as the second leakage causing voltage VM in the storage (Step S120). Note that the second leakage causing voltage VM is denoted by VMy1 in FIG. 7. A symbol "y1" at this time denotes the first leakage detecting operation of yellow. For example, if Step S119 of FIG. 7 is performed once, the first leakage causing voltage VMy1=1360+10×1=1370 V (see L-3 of TABLE 1).

Further, the leakage detection control unit 93 stores the detected second leakage causing voltage VMy1 as a final leakage causing voltage VF in the first leakage detecting operation of yellow in the storage (Step S121). Note that if the updated inter-peak voltage Vy12 exceeds the first leakage causing voltage VNy1 as a result of repeating Step S119 (NO in Step S117), the leakage detection control unit 93 stores the first leakage causing voltage VNy1 as the final leakage causing voltage VF in the first leakage detecting operation of yellow in the storage (Step S122). This is to set the minimum inter-peak voltage at which leakage occurred in the first and second flows as the leakage causing voltage VF. In this way, the leakage causing voltage VF in the first leakage detecting operation of yellow is confirmed (Step S123).

As just described, in this embodiment, the leakage detection control unit 93 increases the inter-peak voltage from the inter-peak voltage (third detection start voltage) smaller than the first leakage causing voltage VN by the first potential interval α at the second potential interval β smaller than the first potential interval α until the first leakage causing voltage VN is reached and detects the inter-peak voltage when leakage is detected again as the second leakage causing voltage VM as the second flow of the leakage detecting operation. Then, the leakage detection control unit 93 sets the detected first or second leakage causing voltage VN or VM as the leakage causing voltage VF in this leakage detecting operation. Since the leakage detecting operation is composed of the first and second flows in this way, the leakage causing voltage VF is detected with higher accuracy.

Thereafter, the second and third leakage detecting operations of yellow are similarly performed. The bias control unit 92 sets the inter-peak voltage to be applied to the developing roller 93 of yellow during the next developing operation based on an average or minimum value of a plurality of leakage causing voltages VF obtained by these plurality of leakage detecting operations of yellow. Thus, the inter-peak voltage to be applied to the developing device 122 can be more reliably set in an area where leakage does not occur.

As described above, in this embodiment, the development bias applying units 88 (88Y, 88M, 88C and 88Bk) are respectively connected to the plurality of developing devices 122 (122Y, 122M, 122C and 122Bk). Since a gap between the photoconductive drum 121 and the developing roller 83 and a gap between the developing roller 83 and the magnetic roller 82 differ among the developing devices 122 of the respective colors, the leakage causing voltage VF also differs. Thus, the leakage detection control unit 93 performs a plurality of leakage detecting operations for each developing device 122. Then, in each developing device 122, an inter-peak voltage to be applied to the developing roller 83 during the next developing operation of the developing device 122 is set based on an average or minimum value of a plurality of leakage causing voltages VF obtained by the plurality of leakage detecting operations.

FIG. 8 diagrammatically shows an example of steps of leakage detecting operations performed for the developing device 122 of each color by a leakage detection control unit in another mode to be compared with this embodiment. Three charts shown on the left side of FIG. 8 show three leakage detecting operations of the developing devices 122 of yellow and cyan. Note that it is assumed that leakage occurs at the same inter-peak voltage in the developing devices 122 of yellow and cyan to simplify description. In each chart, the inter-peak voltage is increased toward a lower side from the aforementioned reference detection start voltage V0 (A-1 of TABLE 1). The first leakage occurs at 1400 V of M-1 of TABLE 1 in the 13th step, and the second leakage occurs at 1370 V of L-3 of TABLE 1 in the 15th step. In other words, steps 1 to 13 of each chart correspond to the aforementioned first flow and steps 14 to 15 correspond to the aforementioned second flow. Note that although the leakage causing voltage VF (L-3 of TABLE 1) of each of three charts is shown to be equal to simplify description, the leakage causing voltage VF actually varies due to repetition.

Similarly, three charts shown on the right side of FIG. 8 show three leakage detecting operations of the developing devices 122 of magenta and black. Note that it is assumed that leakage occurs at the same inter-peak voltage in the developing devices 122 of magenta and black to simplify description. In each chart, the leakage causing voltage VF=1420 V (see M-3 of TABLE 1) is detected in step 16. TABLE 2 is a table showing a total step number of the above series of leakage detecting operations.

TABLE 2

| Total Step Number | |
|---|---|
| | Steps |
| First Color | |
| $1^{st}$ | 15 |
| $2^{nd}$ | 15 |
| $3^{rd}$ | 15 |
| Second Color | |
| $1^{st}$ | 16 |
| $2^{nd}$ | 16 |
| $3^{rd}$ | 16 |
| Third Color | |
| $1^{st}$ | 15 |
| $2^{nd}$ | 15 |
| $3^{rd}$ | 15 |
| Fourth Color | |
| $1^{st}$ | 16 |
| $2^{nd}$ | 16 |
| $3^{rd}$ | 16 |
| Total | 186 |

If three leakage detecting operations are successively performed for the developing device 122 of each color in this way, the leakage detecting operations with 186 steps are necessary as an example. In this case, time necessary for the leakage detecting operations is increased and stop time (down-time) of the image forming apparatus 1 is increased. In this embodiment, in order to perform the leakage detecting operations in a short time, the leakage detection control unit 93 simultaneously performs the leakage detecting operations of as many developing devices 122 as possible. FIGS. 9A, 9B and 9C schematically show an example of steps of leakage detecting operations performed for the developing devices 122 of yellow and cyan by the leakage detection control unit 93 in this embodiment.

In FIGS. 9A to 9C, a total of three results of simultaneously performing the leakage detecting operations for the developing devices 122 of yellow and cyan are shown. Further, a case where leakage occurs at different inter-peak voltages in the simultaneously started developing devices 122 of yellow and cyan is shown in FIGS. 9A to 9C. Specifically, with reference to FIG. 9A, the inter-peak voltages of yellow and cyan are increased in each step toward a lower side from the aforementioned reference detection start voltage V0 (A-1 of TABLE 1) to start the first flow. The first leakage of yellow occurs at 1400 V of M-1 of TABLE 1 in the 13th step and the first flow of yellow is finished. At this time, the leakage detection control unit 93 temporarily interrupts the leakage detecting operation of yellow. Further, the inter-peak voltage is increased for the developing device 122 of cyan and the first leakage of cyan occurs at 1450 V of N-1 of TABLE 1 in the $14^{th}$ step. Thereafter, the leakage detection control unit 93 starts the second flow ($15^{th}$ step) of the developing device 122 of yellow. Leakage occurs again at 1370 V of L-3 of TABLE 1 in the $16^{th}$ step, whereby the second flow of yellow is finished. Further, the leakage detection control unit 93 starts the second flow of the developing device 122 of cyan ($17^{th}$ step). Leakage occurs again at 1420 V of M-3 of TABLE 1 in the $18^{th}$ step, whereby the second flow of cyan is finished. As a result, the first leakage detecting operations of yellow and cyan are finished and each leakage causing voltage VF is detected. Also in FIGS. 9B and 9C, leakage detecting operations similar to those of FIG. 9A are performed. TABLE 3 is a table showing a total step number when the above leakage detecting operations are performed three times in each of the developing devices 122 of yellow and cyan and similar leakage detecting operations are performed also in the developing devices 122 of magenta and black.

TABLE 3

| Total Step Number | |
|---|---|
| | Steps |
| First and Second Colors | |
| $1^{st}$ | 18 |
| $2^{nd}$ | 18 |
| $3^{rd}$ | 18 |
| Third and Fourth Colors | |
| $1^{st}$ | 18 |
| $2^{nd}$ | 18 |
| $3^{rd}$ | 18 |
| Total | 108 |

As shown in FIGS. 9A to 9C and TABLE 3, the leakage detecting operation of two colors is finished with 18 steps each time. Thus, the total step number when the leakage detecting operation of each of four colors is performed three times is 108. Thus, as compared with the total step number of 186 in the other mode previously shown in FIG. 8 and TABLE 2, the leakage detecting operations can be completed while time is shortened by 42%.

As just described, in this embodiment, if the first leakage causing voltage VN is detected at an inter-peak voltage in one of the plurality of developing devices 122, the leakage detection control unit 93 interrupts the leakage detecting operation of this developing device 122 until the first leakage causing voltages VN of the other developing devices are detected, and successively performs the second flow for each developing device 122 after the first leakage causing voltages VN of all the plurality of developing devices 122 are detected. In this case, after leakage simultaneously occurs in the plurality of developing devices 122, the first flows (rough adjusting operations) of the plurality of developing devices 122 and the second flow (fine adjusting operations) of the plurality of developing devices 122 can be successively performed.

Note that, in another embodiment, if the first leakage causing voltage VN is detected at an inter-peak voltage in one of the plurality of developing devices 122, the leakage detection control unit 93 may interrupt the leakage detecting operations of the other developing devices 122 and resume the leakage detecting operations of the other developing devices 122 after the second flow (fine adjusting operation) of the developing device 122, for which the first leakage causing voltage VN was detected, is performed. Specifically, if the first leakage causing voltage VN of yellow is detected in the 13th step of FIG. 9A, the leakage detecting operation of cyan is interrupted and a transition is made to the second flow shown in the 15th and 16th steps. Thereafter, the first flow of cyan shown in the 14th step is performed and the second flow of cyan shown in the 17th and 18th steps is performed. Also in this case, after leakage simultaneously occurs in the plurality of developing devices 122, the first flows (rough adjusting operations) of the plurality of developing devices 122 and the second flow (fine adjusting operations) of the plurality of developing devices 122 can be successively performed.

In the simultaneous leakage detecting operation of two colors described in FIG. 9A, leakage may occur at different inter-peak voltages in the two developing devices 122, but leakage may actually occur at the same inter-peak voltage. However, if the development bias applying units 88 of the respective colors are adjacently arranged on one substrate as shown in FIG. 6, leakage having occurred in one developing device 122 may cause noise in the development bias applying units 88 of the other developing devices 122. Thus, if leakage is simultaneously detected in the developing devices 122 of two colors, it is unclear whether each leakage detection is caused by actually occurred leakage or one leakage detection is error detection made due to noise.

FIG. 10 diagrammatically shows an example of steps of leakage detecting operations performed for the developing device 122 of each color by a leakage detection control unit in another mode to be compared with this embodiment. Three charts shown in FIG. 10 show three leakage detecting operations of the developing device 122 of yellow. In each chart, the inter-peak voltage is increased toward a lower side from the aforementioned reference detection start voltage V0 (A-1 of TABLE 1). The first leakage occurs at 1400 V of M-1 of TABLE 1 in the 13th step, and the second leakage occurs at 1370 V of L-3 of TABLE 1 in the 15th step. In other words, steps 1 to 13 of each chart correspond to the aforementioned first flow and steps 14 to 15 correspond to the aforementioned second flow. Note that although the leakage causing voltage VF (L-3 of TABLE 1) of each chart for the three leakage detecting operations is shown to be equal to simplify description, the leakage causing voltage VF actually varies due to repetition. TABLE 4 is a table showing a total step number when the leakage detecting operations shown in FIG. 10 are performed for each of the developing devices 122 of four colors.

TABLE 4

| Total Step Number | |
|---|---|
| | Steps |
| First Color | |
| $1^{st}$ | 15 |
| $2^{nd}$ | 15 |
| $3^{rd}$ | 15 |
| Second Color | |
| $1^{st}$ | 15 |
| $2^{nd}$ | 15 |
| $3^{rd}$ | 15 |
| Third Color | |
| $1^{st}$ | 15 |
| $2^{nd}$ | 15 |
| $3^{rd}$ | 15 |
| Fourth Color | |
| $1^{st}$ | 15 |
| $2^{nd}$ | 15 |
| $3^{rd}$ | 15 |
| Total | 180 |

If three leakage detecting operations are successively performed for the developing device 122 of each color in this way, the leakage detecting operations with 180 steps are necessary as an example. Also in this case, time necessary for the leakage detecting operations is increased and stop time (down-time) of the image forming apparatus 1 is increased. On the other hand, in the leakage detecting operations according to this embodiment, the leakage detection control unit 93 simultaneously starts the leakage detecting operations for these plurality of developing devices 122 and performs the leakage detecting operations of the developing devices 122, in which leakage simultaneously occurred, while switching them one by one if the leakage simultaneously occurs at an inter-peak voltage in a plurality of developing devices 122. FIGS. 11A, 11B and 11C diagrammatically show an example of steps of the leakage detecting operations performed for the developing devices 122 of yellow and cyan by the leakage detection control unit 93 in this embodiment.

In FIGS. 11A to 11C, a total of three results of simultaneously performing the leakage detecting operations for the developing devices 122 of yellow and cyan are shown. Further, a case where leakage occurs at the same inter-peak voltage in the simultaneously started developing devices 122 of yellow and cyan is shown in FIGS. 11A to 11C. Specifically, with reference to FIG. 11A, the inter-peak voltages of yellow and cyan are increased in each step toward a lower side from the aforementioned reference detection start voltage V0 (A-1 of TABLE 1) to start the first flow. The first leakages of yellow and cyan occur at 1400 V of M-1 of TABLE 1 in the $13^{th}$ step. If the leakage simultaneously occurs in this way, the leakage detection control unit 93 does not immediately determine that the inter-peak voltage of 1400 V in the $13^{th}$ step is a correct first leakage causing voltage VN. In this case, the leakage detection control unit 93 interrupts the leakage detecting operation of cyan and resumes the first flow of yellow in the $14^{th}$ step. Particularly, the leakage detection control unit 93 resumes the first flow at 1350 V (see L-1 of TABLE 1) lower than 1400 V in the $13^{th}$ step by 50 V (first potential interval $\alpha$). If leakage of yellow singly occurs in the $15^{th}$ step, the inter-peak voltage 1400 V in this step is stored as the first leakage causing voltage VN in the unillustrated storage. As described, since the leakage detecting operation of cyan is interrupted at this time, the above first leakage causing voltage VN is known to be a correct value not affected by noise. Thereafter, the leakage detection control unit 93 performs the second flow of the developing device 122 of yellow in the $16^{th}$ and $17^{th}$ steps and detects a second leakage causing voltage 1370 V (see L-3 of TABLE 1). Further, the leakage detection control unit 93 resumes the first flow of the interrupted leakage detecting operation of cyan. Also at this time, as for yellow, the leakage detection control unit 93 resumes the first flow at 1350 V (see L-1 of TABLE 1) lower than 1400 V in the $13^{th}$ step by 50 V (first potential interval $\alpha$). Thereafter, the second leakage causing voltage 1370 V of cyan is similarly detected (see L-3 of TABLE 1). Also in FIGS. 11B and 11C, the leakage detecting operations similar to those of FIG. 11A are performed. TABLE 5 is a table showing a total step number when the above leakage detecting operation is performed three times in the developing devices 122 of yellow and cyan and similar leakage detecting operations are performed also in the developing devices 122 of magenta and black.

TABLE 5

| Total Step Number | |
|---|---|
| | Steps |
| First and Second Colors | |
| $1^{st}$ | 21 |
| $2^{nd}$ | 21 |
| $3^{rd}$ | 21 |
| Third and Fourth Colors | |
| $1^{st}$ | 21 |
| $2^{nd}$ | 21 |
| $3^{rd}$ | 21 |
| Total | 126 |

As shown in FIGS. 11A to 11C and TABLE 5, the leakage detecting operation of two colors is finished with 21 steps each time. Thus, the total step number when the leakage detecting operations of four colors are performed three times is 126. Thus, as compared with the total step number of 186 in the other mode shown in FIG. 10 and TABLE 4, the leakage detecting operations can be completed while time is shortened by 30%.

As just described, in this embodiment, if leakage simultaneously occurs in a plurality of developing devices 122 at an inter-peak voltage, the leakage detection control unit 93 performs the first flow again and performs the second flow for each of the developing devices 122 in which the leakage was detected. Thus, the leakage detecting operations of the plurality of developing devices 122 can be simultaneously performed in parallel until the leakage simultaneously occurs in the plurality of developing devices 122, and the leakage detecting operations are performed in a short time. Even if leakage is erroneously detected in the other developing device 122 due to noise from the leakage having occurred in one developing device 122, the leakage causing voltage VF is accurately detected by the retried first flow and the second flow. At this time, the leakage detection control unit 93 increases the inter-peak voltage at the first potential interval $\alpha$ from an inter-peak voltage (third detection start voltage, corresponding to the $14^{th}$ and $18^{th}$ steps of FIG. 11A) larger than the reference detection start voltage V0 (first detection start voltage) in the first flow performed again for each of the developing devices 122 in which the leakage was simultaneously detected. Particularly in this embodiment, the first flow is resumed at a voltage (second detection start voltage) smaller than the aforementioned first leakage causing voltage VN by the first potential interval $\alpha$. Thus, the first flow performed again can be efficiently completed in a short time.

Further, in this embodiment, the leakage detection control unit 93 simultaneously performs the leakage detecting operations of the developing devices 122 of yellow and cyan and simultaneously performs the leakage detecting operations of the developing devices 122 of magenta and black as described above. In other words, with reference to FIG. 6, the leakage detection control unit 93 simultaneously performs the leakage detecting operations for two developing devices 122 corresponding to two bias applying units 88 not adjacent on the substrate 881. Thus, it can be prevented that the leakage detecting operations of the developing devices 122 easily receiving noise from each other are simultaneously performed.

Figure 12:
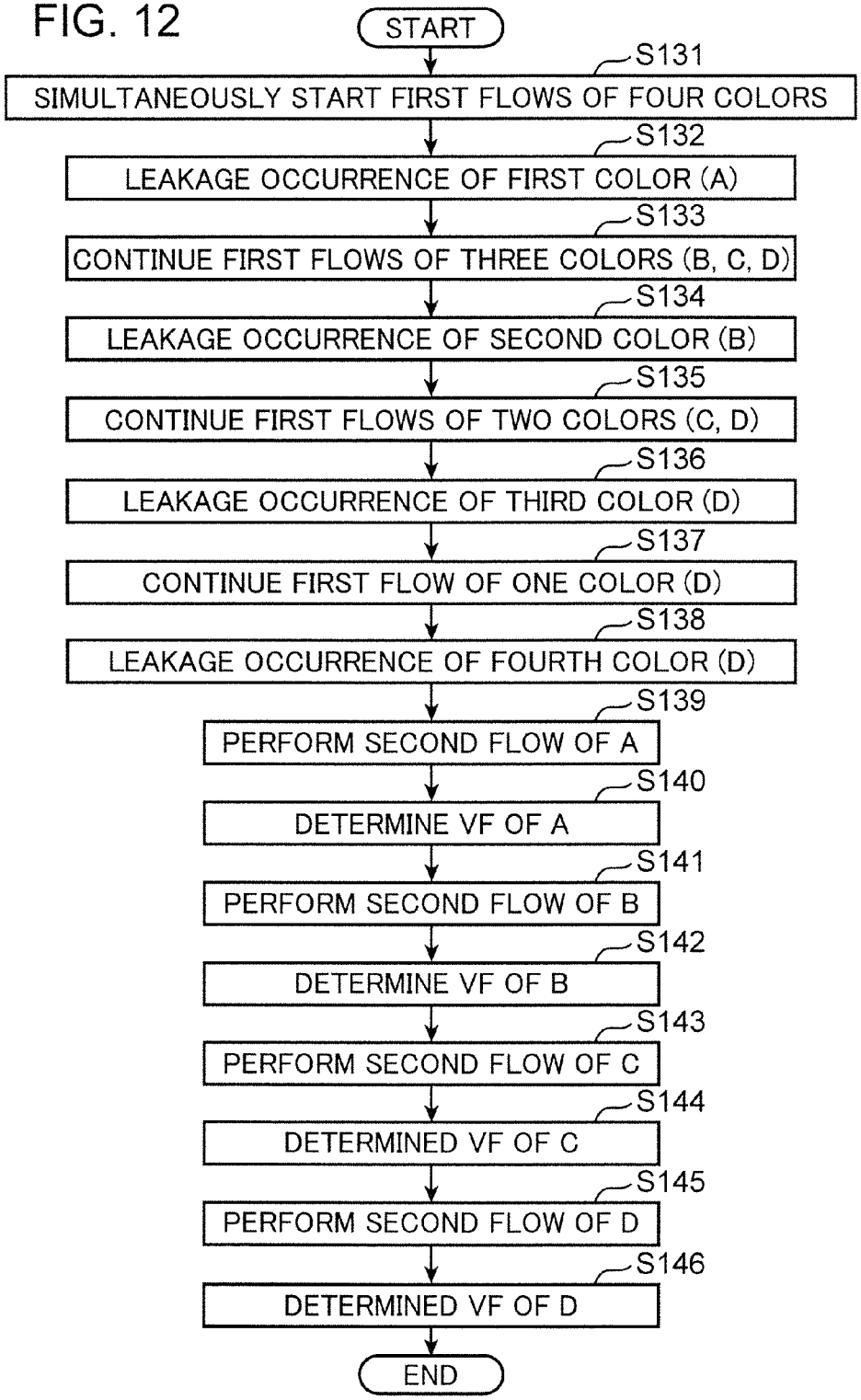
FIG. 12 is a flow chart of leakage detecting operations according to a second embodiment of the present disclosure.

Next, leakage detecting operations according to a second embodiment of the present disclosure are described. FIG. 12 is a flow chart of the leakage detecting operations according to this embodiment. In this embodiment, the leakage detection control unit 93 performs the leakage detecting operations as in the previous first embodiment. Note that, in this embodiment, an execution order of the leakage detecting operations of the developing devices 122 of four colors is different as compared with the first embodiment, wherefore only a point of difference is described and other common points are not described. In FIG. 12, the developing devices 122 (122Y, 122M, 122C and 122Bk) of yellow, magenta, cyan and black are respectively denoted and shown by A, B, C and D in the order of leakage occurrence. Further, in FIG. 12, it is assumed that leakage occurs at different inter-peak voltages in the developing devices 122 of four colors.

With reference to FIG. 12, the leakage detection control unit 93 simultaneously starts first flows of the leakage detecting operations of the developing devices 122 of four colors (Step S131). Eventually, as inter-peak voltages increase, leakage occurs in the developing device 122 of the first color (A) (Step S132). Specifically, the first flow of the developing device 122 of the first color (A) is finished. At this time, the leakage detection control unit 93 interrupts the leakage detecting operation of the first color (A) and continues the first flows of the developing devices 122 of the other three colors (B, C, D) (Step S133). Eventually, as the inter-peak voltages increase, leakage occurs in the developing device 122 of the second color (B) (Step S134). Similarly, leakage occurs in the developing devices 122 of the third color (C) and the fourth color (D) from Step S135 to Step S138.

Subsequently, the leakage detection control unit 93 performs a second flow of the developing device 122 of the first color (A) in which the leakage first occurred (Step S139). As a result, a leakage causing voltage VF of the first color (A) is determined (Step S140). Similarly, leakage causing voltages VF of the other three colors (B, C, D) are determined from Step S141 to Step S146, and one leakage detecting operation is completed for each of the developing devices 122 of four colors. Also in this embodiment, the leakage detecting operations of the plurality of developing devices 122 can be performed in a short time.

Figure 13:
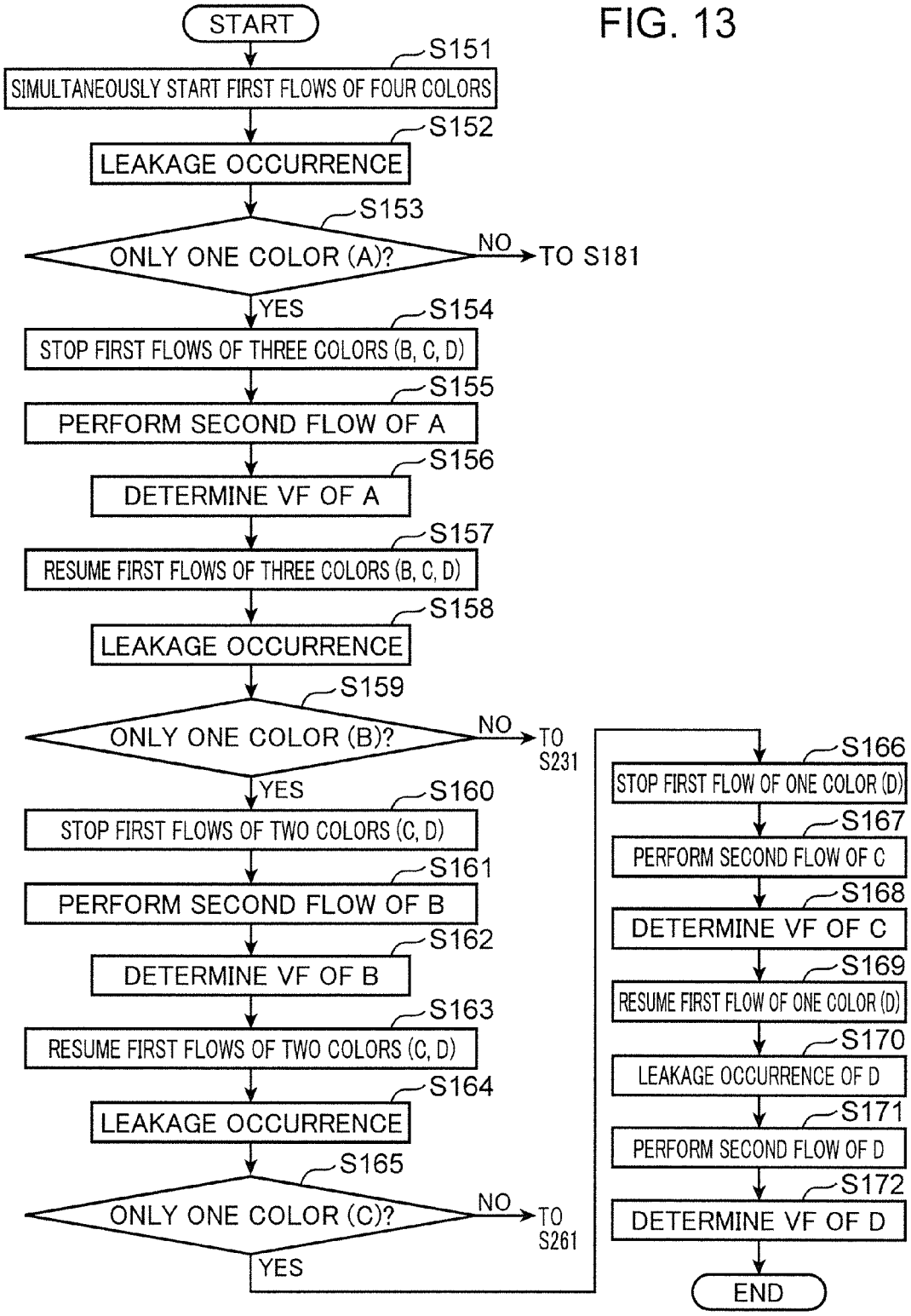
FIG. 13 is a part of a flow chart of leakage detecting operations according to a third embodiment of the present disclosure.
Figure 14:
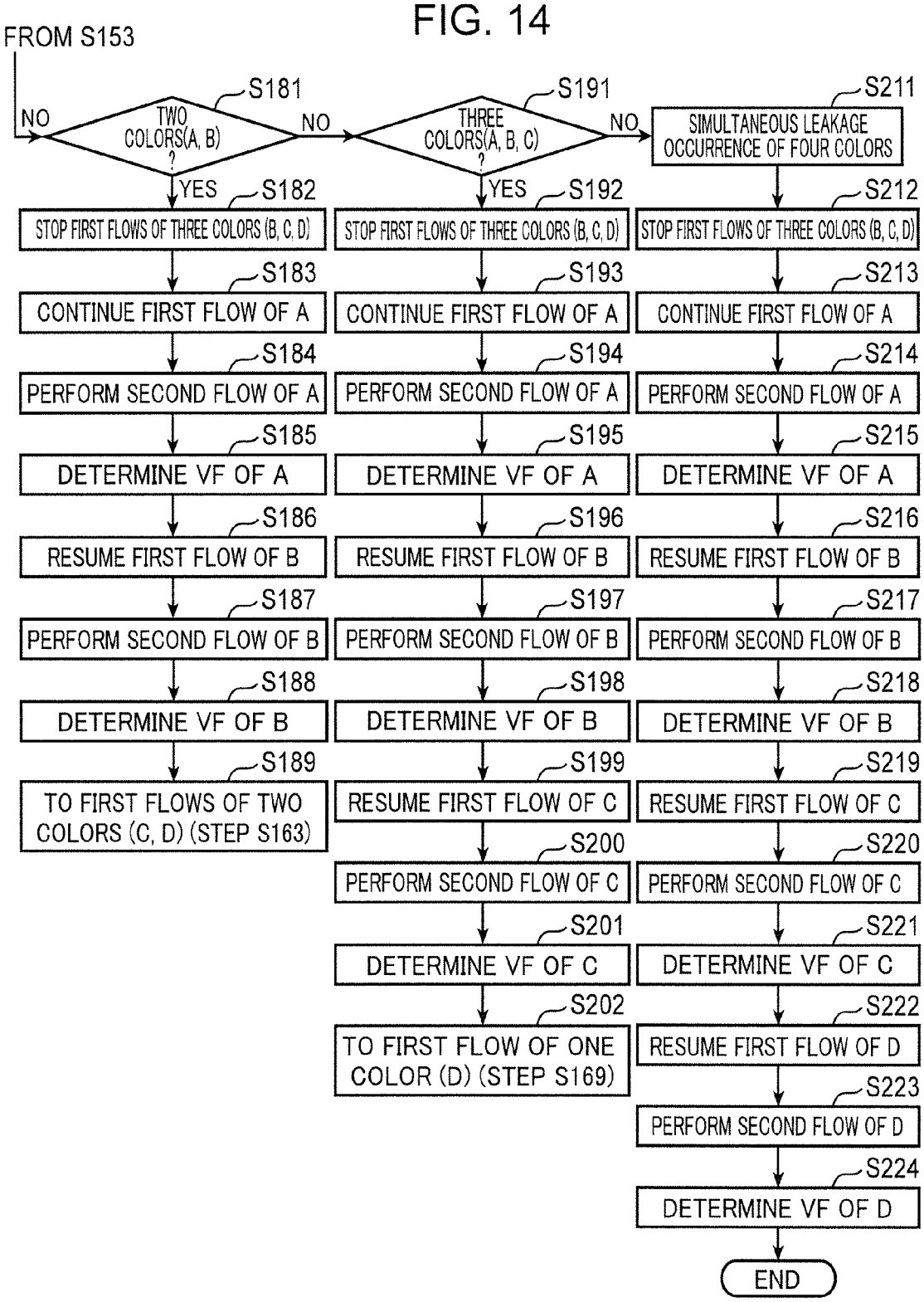
FIG. 14 is a part of the flow chart of the leakage detecting operations according to the third embodiment of the present disclosure.
Figure 15:
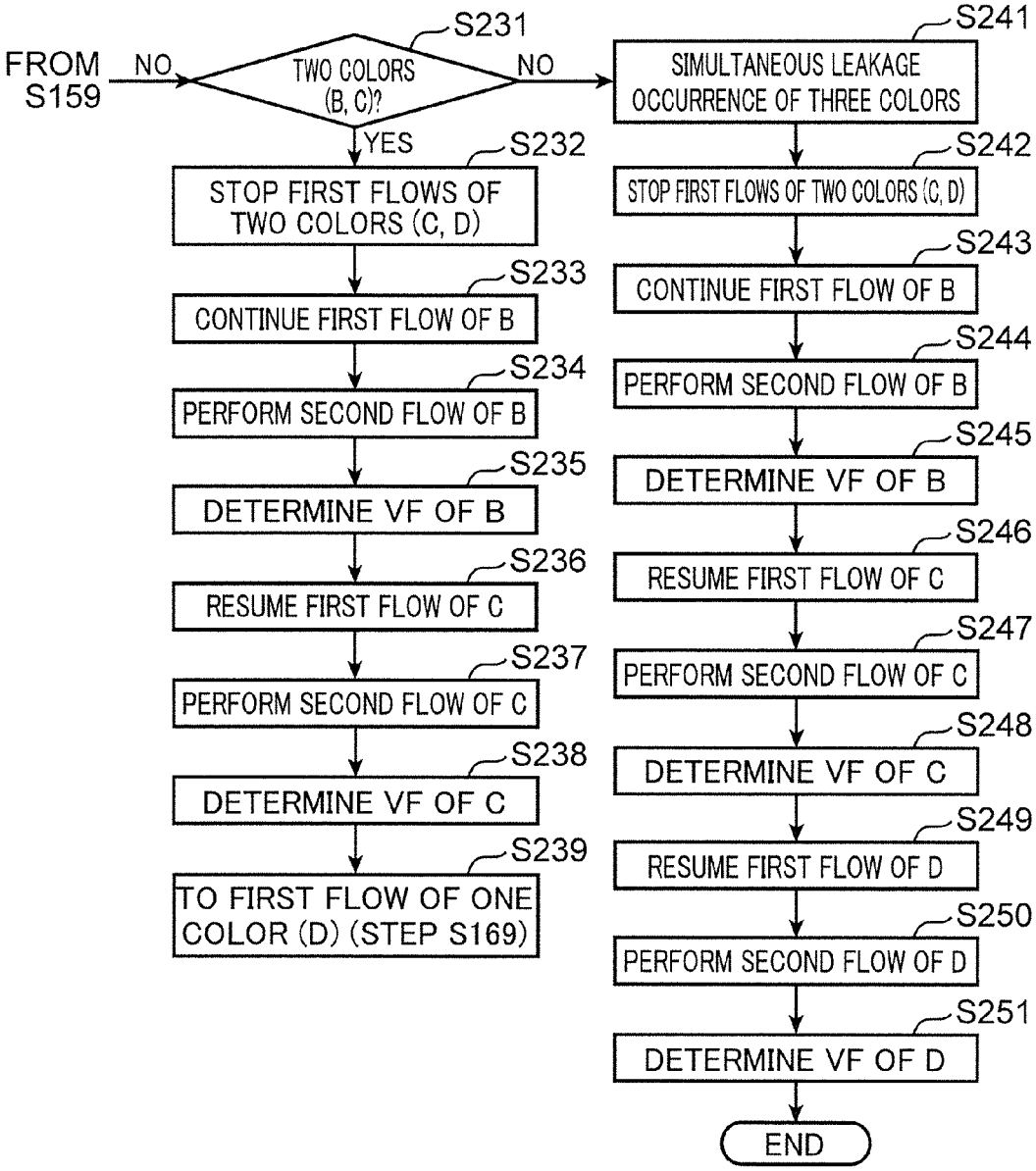
FIG. 15 is a part of the flow chart of the leakage detecting operations according to the third embodiment of the present disclosure.

Next, leakage detecting operations according to a third embodiment of the present disclosure are described. Each of FIGS. 13 to 15 is a part of a flow chart of leakage detecting operations according to this embodiment. In this embodiment, the leakage detection control unit 93 performs the leakage detecting operations as in the previous first embodiment. Also in this embodiment, an execution order of the leakage detecting operations of the developing devices 122 of four colors is different as compared with the first embodiment, wherefore only a point of difference is described and other common points are not described. In FIGS. 13 to 15, the developing devices 122 (122Y,122M, 122C and 122Bk) of yellow, magenta, cyan and black are respectively denoted and shown by A, B, C and D in the order of leakage occurrence.

With reference to FIG. 13, the leakage detection control unit 93 simultaneously starts first flows of the leakage detecting operations of the developing devices 122 of four colors (Step S151). Eventually, as inter-peak voltages increase, leakage occurs in any of the developing devices 122 (Step S152). At this time, the leakage detection control unit 93 determines whether the leakage has occurred in one developing device 122 or in a plurality of developing devices 122 (Step S153). If the leakage has occurred in one developing device 122 (first color (A)) (YES in Step S153), the leakage detection control unit 93 stops the leakage detecting operations of the other three colors (B, C, D) (Step S154) and performs a second flow of the first color (A) (Step S155). When a leakage causing voltage VF of the first color (A) is determined (Step S156), the leakage detection control unit 93 resumes the first flows of the other three colors (B, C, D) (Step S157).

Eventually, as the inter-peak voltages increase, leakage occurs in any of the developing devices 122 of the three colors (Step S158). At this time, the leakage detection control unit 93 determines whether the leakage has occurred in one developing device 122 or in a plurality of developing devices 122 (Step S159). If the leakage has occurred in one developing device 122 (second color (B)) (YES in Step S159), the leakage detection control unit 93 stops the leakage detecting operations of the other two colors (C, D) (Step S160) and performs a second flow of the second color (B) (Step S161). When a leakage causing voltage VF of the second color (B) is determined (Step S162), the leakage detection control unit 93 resumes the first flows of the other two colors (C, D) (Step S163). Eventually, as the inter-peak voltages increase, leakage occurs in any of the developing devices 122 of the two colors (Step S164). The leakage detection control unit 93 determines whether the leakage has occurred in one developing device 122 or in a plurality of developing devices 122 (Step S165). If the leakage has occurred in one developing device 122 (third color (C)) (YES in Step S165), the leakage detecting operations of the developing devices 122 of four colors are finished by way of Steps S166 to S172 similar to the above.

On the other hand, if the leakage has occurred in a plurality of developing devices 122 in Step S153 of FIG. 13 (NO in Step S153), the leakage detection control unit 93 determines whether or not the leakage has occurred in the developing devices 122 of two colors (Step S181 of FIG. 14). If the leakage has occurred in two developing devices 122 (first color (A), second color (B) (YES in Step S181), the leakage detection control unit 93 stops the first flows of three colors (B, C, D) (Step S182) and continues the first flow of the first color (A) (Step S183). This is because, as in the previous first embodiment, one leakage occurrence is possibly erroneous detection if leakage simultaneously occurs in two developing devices 122. Note that the first flow of the first color (A) continued in Step S183 may be started at a voltage smaller than the first leakage causing voltage VN by the first potential interval $\alpha$ as in FIG. 11A. Thereafter, if leakage of the first color (A) is singly detected, the leakage causing voltage VF is determined (Step S185) by way of the second flow (Step S184). The leakage detection control unit 93 similarly resumes the first flow of the second color (B) out of the developing devices 122 of three colors for which the leakage detecting operations were stopped (Step S186). Then, the leakage causing voltage VF is determined (Step S188) by way of the second flow (Step S187). The leakage detection control unit 93 transitions to the first flows in Step S163 of FIG. 13 and continues the leakage detecting operations for the developing devices 122 of the remaining two colors (C, D) (Step S189).

On the other hand, if the leakage has not occurred in two developing devices 122 in Step S181 of FIG. 14 (NO in Step S181), the leakage detection control unit 93 determines whether or not the leakage has occurred in the developing devices 122 of three colors (Step S191). If the leakage has occurred in the developing devices 122 of three colors (first color (A), second color (B), third color (C)) (YES in Step S191), the leakage detection control unit 93 stops the first flows of the three colors (B, C, D) (Step S192) and continues the first flow of the first color (A) (Step S193). Thereafter, if leakage of the first color (A) is singly detected, the leakage causing voltage VF is determined (Step S195) by way of the second flow (Step S194). The leakage detection control unit 93 similarly resumes the first flow of the second color (B) out of the developing devices 122 of three colors for which the leakage detecting operations were stopped (Step S196). Then, the leakage causing voltage VF of the second color (B) is determined (Step S198) by way of the second flow (Step S197). The leakage detection control unit 93 transitions to the first flow in Step S169 of FIG. 13 and continues the leakage detecting operation for the developing device of the remaining one color (D) (Step S202) after the leakage causing voltage VF of the third color (C) is similarly determined in Steps S199 to S201.

On the other hand, if the leakage has occurred in the developing devices 122 of four colors (first color (A), second color (B), third color (C), fourth color (D)) (NO in Step S191, Step S211), the leakage detection control unit 93 successively performs the leakage detecting operations (first flows, second flows) of the developing devices 122 of four colors to determine the leakage causing voltage VF of each color in Steps S212 to S224.

Further, if leakage has occurred in a plurality of developing devices 122 in Step S159 of FIG. 13 (NO in S159), the leakage detection control unit 93 determines whether or not the leakage has occurred in the developing devices 122 of two colors (Step S231 of FIG. 15). If the leakage has occurred in two developing devices 122 (second color (B), third color (C)) (YES in Step S231), the leakage detection control unit 93 stops the first flows of two colors (C, D) (Step S232) and continues the first flow of the second color (B) (Step S233). Thereafter, if leakage of the second color (B) is singly detected, the leakage causing voltage VF is determined (Step S235) by way of the second flow (Step S234). The leakage detection control unit 93 similarly resumes the first flow of the third color (C) out of the developing devices 122 of two colors for which the leakage detecting operations were stopped (Step S236). Then, the leakage causing voltage VF of the third color (C) is determined (Step S238) by way of the second flow (Step S237). The leakage detection control unit 93 transitions to the first flow in Step S169 of FIG. 13 and continues the leakage detecting operation for the developing device 122 of the remaining one color (D) (Step S239). Further, if the leakage has simultaneously occurred in the developing devices 122 of three colors in Step S231 (No in Step S231, Step S241), the leakage detection control unit 93 successively performs the leakage detecting operations (first flows, second flows) of the developing devices 122 of three colors and determines the leakage causing voltage VF of each color in Steps S242 to S251.

Figure 16:
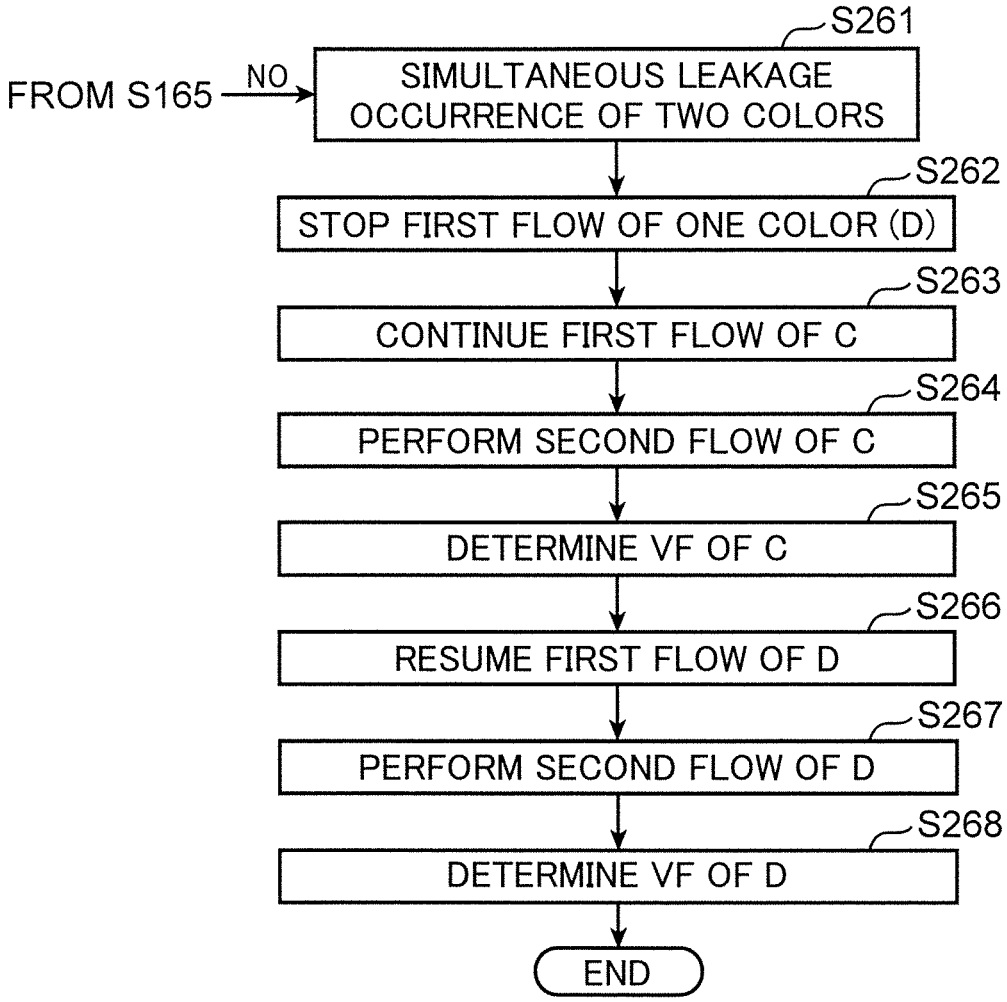
FIG. 16 is a part of the flow chart of the leakage detecting operations according to the third embodiment of the present disclosure.

Further, if leakage has occurred in a plurality of developing devices 122 in Step S165 of FIG. 13 (NO in Step S165, S261 of FIG. 16), the leakage detection control unit 93 successively performs the leakage detecting operations (first flows, second flows) of the developing devices 122 of two colors and determines the leakage causing voltage VF of each color in Steps S262 to S268.

As described above, in this embodiment, the leakage detecting operations of the developing devices 122 of four colors are simultaneously started. If leakage has occurred in one developing device 122, the second flow of this developing device 122 is performed and the leakage causing voltage VF is determined. The leakage causing voltages VF are similarly successively determined for the remaining developing devices 122. On the other hand, if leakage has simultaneously occurred in a plurality of developing devices 122, it can be prevented to derive the leakage causing voltage VF based on erroneous detection by performing the first flow again by predetermined steps for these developing devices 122. Further, time spent on the leakage detecting operations can be shortened while the leakage detecting operations are simultaneously performed with the inter-peak voltages increased for the plurality of developing devices 122.

Although the image forming apparatus 1 according to each embodiment of the present disclosure has been described above, the present disclosure is not limited to this. For example, the following modifications can be adopted.

(1) Although four developing devices 122 and four leakage detecting units 89 are arranged in correspondence with different colors of toner in each of the above embodiments, the present disclosure is not limited to this. Four or more developing devices 122 and four or more leakage detecting units 89 may be arranged in correspondence with the colors of toner.

(2) Although the first flows of the leakage detecting operations of the plurality of developing devices 122 are simultaneously performed in each of the above embodiments, the present disclosure is not limited to this. The second flows of the leakage detecting operations of the plurality of developing devices 122 may be simultaneously performed. Also in this case, if leakage simultaneously occurs in a plurality of developing devices 122, time required for the leakage detecting operations can be shortened while eliminating the influence of noise on erroneous leakage detection by resuming the second flow at an inter-peak voltage smaller by a predetermined value in each developing device 122.

Note that if the leakage detecting operations are simultaneously performed in the plurality of developing devices 122, it is desirable to apply leakage detection voltages at the same timing. This is because noise generated when a development bias is on or off in the developing device 122 of one color may affect detecting circuits of the developing devices 122 of the other colors.

Figure 17:
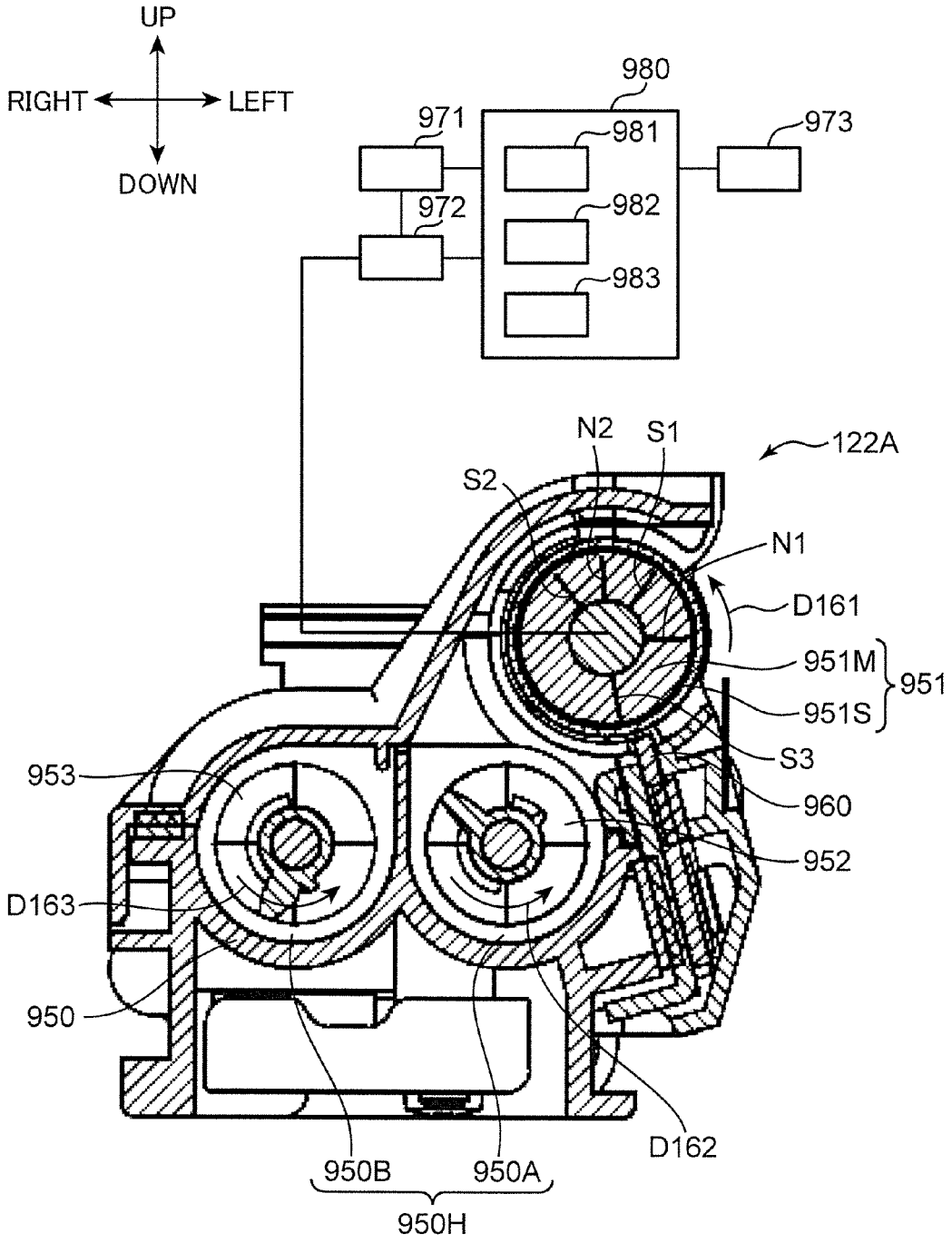
FIG. 17 is a sectional view and an electrical block diagram of a developing device according to a modification of the present disclosure.

(3) Further, although the developing device 122 including the developing roller 83 and the magnetic roller 82 and adopting the touch-down development method is described in the above embodiments, the present disclosure is not limited to this. FIG. 17 is a sectional view of a developing device 122A and a block diagram showing an electrical configuration of a control unit 980 according to a modification of the present disclosure. The developing device 122A includes a development housing 950, a developing roller 951, a first screw feeder 952, a second screw feeder 953 and a regulation blade 960. A two-component development method is applied to the developing device 122A. Further, four unillustrated photoconductive drums and four developing devices 122A are arranged in correspondence with yellow, magenta, cyan and black colors.

The development housing 950 includes a developer storage 950H. A two-component developer composed of toner and carrier is contained in the developer storage 950H. Further, the developer storage 950H includes a first conveying portion 950A in which the developer is conveyed in a first conveying direction from one end side toward the other end side in an axial direction of the developing roller 951 (direction perpendicular to the plane of FIG. 17, direction from back to front) and a second conveying portion 950B which communicates with the first conveying portion 950A at opposite axial end parts and in which the developer is conveyed in a second conveying direction opposite to the first conveying direction. The first and second screw feeders 952, 953 are rotated in directions of arrows D162, D163 of FIG. 17 and respectively convey the developer in the first and second conveying directions. Particularly, the first screw feeder 952 supplies the developer to the developing roller 951 while conveying the developer in the first conveying direction. Further, by rotating the first and second screw feeders 952, 953, the two-component developer composed of toner and carrier in the developer storage 950H is agitated and charged.

The developing roller 951 is arranged at a distance from the unillustrated photoconductive drum (image carrier) on a surface of which an electrostatic latent image is to be formed. The developing roller 951 includes a rotary sleeve 951S and a magnet 951M fixedly arranged in the sleeve 951S. The magnet 951M has poles S1, N1, S2 and N2. The developing roller 951 is rotated in a direction of an arrow D161 of FIG. 17. The developing roller 951 receives the developer in the development housing 950H, carries a developer layer (magnetic brush) and supplies the toner to the photoconductive drum.

The regulation blade 960 is arranged at a predetermined distance from the developing roller 951 and regulates a layer thickness of the magnetic brush of the developer supplied onto a circumferential surface of the developing roller 951 from the first screw feeder 952. The developer layer regulated by the regulation blade 960 is conveyed to a development nip formed between the photoconductive drum and the developing roller 951.

An image forming apparatus (not shown) in which the developing device 122A is mounted includes a development bias applying unit 972 (bias applying unit), a leakage detecting unit 971, the control unit 980 and a driving unit 973 as in the previous embodiments.

The development bias applying unit 972 is composed of a direct-current power supply and an alternating-current power supply and applies a development bias, in which an alternating-current voltage is superimposed on a direct-current voltage, to the developing roller 951 of the developing device 122A based on a control signal from a bias control unit 982 or a leakage detection control unit 983 to be described later.

The leakage detecting unit 971 is electrically connected to the development bias applying unit 972. The leakage detecting unit 971 detects leakage occurring between the photoconductive drum and the developing roller 951. Specifically, the leakage detecting unit 971 detects the leakage based on a variation of the value of a current (overcurrent) flowing in the developing roller 951.

The driving unit 973 is composed of a motor and a gear mechanism for transmitting a torque of the motor and rotationally drives the developing roller 951, the first screw feeder 952 and the second screw feeder 953 in the developing device 122A in addition to the photoconductive drum 121 during a developing operation and a leakage detecting operation in accordance with a control signal from the control unit 980 as in the previous embodiments.

The control unit 980 functions to include a drive control unit 981, the bias control unit 982 and the leakage detection control unit 983 by a CPU executing a control program stored in a ROM.

The drive control unit 981 rotationally drives the developing roller 951, the first screw feeder 952 and the second screw feeder 953 by controlling the driving unit 973. Further, the drive control unit 981 rotationally drives the photoconductive drum by controlling an unillustrated drive mechanism. In this modification, the drive control unit 981 rotationally drives each of the above members in the developing operation and the leakage detecting operation.

The bias control unit 982 provides potential differences of a direct-current voltage and an alternating-current voltage between the photoconductive drum and the developing roller 951 by controlling the development bias applying unit 972 during the developing operation in which the toner is supplied from the developing roller 951 to the photoconductive drum. The toner in the development nip is transferred from the developing roller 951 to the photoconductive drum by the above potential differences.

The leakage detection control unit 983 applies a direct-current voltage and an alternating-current voltage to the developing roller 951 by controlling the development bias applying unit 972 during the leakage detecting operation. In the leakage detecting operation, an inter-peak voltage of the alternating-current voltage at which leakage occurs is detected out of the development bias applied to the developing roller 951. At this time, the leakage detection control unit 983 causes leakage to occur between the photoconductive drum and the developing roller 951 while increasing the inter-peak voltage of the alternating-current voltage of the development bias. Also in this modification, the leakage detecting operation is performed prior to the developing operation, i.e. at a time different from that of the developing operation to detect the inter-peak voltage (leakage causing voltage) at which leakage occurs. As a result, the inter-peak voltage of the alternating-current voltage is set in a range not reaching the leakage causing voltage and the occurrence of leakage is prevented during the developing operation.

Also in this modification, the leakage detection control unit 983 simultaneously starts the leakage detecting operations for the plurality of developing devices 122A and performs the leakage detecting operations of the developing devices 122A, in which leakage simultaneously occurred, while switching them one by one if the leakage occurs in a plurality of developing devices 122A at an inter-peak voltage.

A control similar to that in the previous embodiments can be executed as a detailed control of each leakage detecting operation in this modification. Specifically, the procedure of the leakage detecting operations in the aforementioned first to third embodiments is applicable also to the developing device 122A of each color. As a result, even if a plurality of developing devices 122A are arranged in correspondence with a plurality of colors, the number of steps required for the leakage detecting operations can be reduced.

Note that an example of conditions during a specific leakage detecting operation of the developing device 122A adopting the two-component development method is shown below.

Print speed of the image forming apparatus 1: 55 pages/min

Process speed: 295 mm/s

Photoconductive drum: a-Si photoconductor

Surface roughness of the sleeve 951 of the developing roller 951: Rz=5.5 μm Volume specific resistance of the carrier: $10^{14}$ Ω·cm Saturation magnetization of the carrier: 55 emu/g Average particle diameter of the carrier: 35 μm Toner: average particle diameter of 6.8 μm, positively charged Developer conveying amount on the developing roller 951: 11 mg/cm$^2$ Circumferential speed of the developing roller 951: ratio of 1.8 (with rotation) to that of the photoconductive drum Gap between the photoconductive drum and the developing roller 951: 0.30 mm Direct-current voltage $V_{slv_dc}$ of the developing roller 951: 200 V Alternating-current voltage ($V_{pp}$) $V_{slv_ac}$ of the developing roller 951: variable (3.0 kHz)

Duty ratio of the alternating-current voltage of the developing roller 951: 50%

Image part potential VL of the photoconductive drum: +30 V

Background part potential Vo of the photoconductive drum: +300 V

Note that a surface potential of the facing photoconductive drum is set at the background part potential Vo in performing the leakage detecting operation in the developing device 122A. At this time, $V_{slv_dc}$ as a DC component of the development bias is desirably set in a range of $Vo-100 \leq V_{slv_dc} \leq Vo$. If $Vo-100 > V_{slv_dc}$, a carrier development in which the carrier is developed from the developing roller 951 to the photoconductive drum during the leakage detecting operation is likely to occur. On the other hand, if $V_{slv_dc} > V0$, toner fogging occurs during the leakage detecting operation and toner is likely to be uselessly consumed.

As described above, if the surface potential of the photoconductive drum is set at the background potential Vo, leakage is detected in a background part (blank part) of the photoconductive drum. Thus, it is desirable to suppress the damage of the surface of the photoconductive drum. In this case, the leakage occurs due to a potential difference between Vmin of the development bias applied to the developing roller 951 and the background part potential Vo of the photoconductive drum. Note that Vmin is a peak value when the development bias is most distant from the background part potential Vo in a cycle of an alternating-current component of the development bias. In the above case, the leakage occurs at a potential on a negative side of the development bias.

If negative electric charges are applied to the surface of the photoconductive drum having a positive polarity, it is difficult to remove a potential caused by the electrical charges. Such a potential history may affect the next detecting operation. Thus, in the case of the two-component development method as in this modification, a transfer bias applied to a transfer member (member facing the photoconductive drum such as a transfer roller) is set to have the same polarity (positive polarity here) as the photoconductive drum during the leakage detecting operation. As a result, even if electric charges having a negative polarity are applied to the photoconductive drum, electric charges on the photoconductive drum and those on the transfer member cancel out each other. As a result, unnecessary electric charges can be removed from the photoconductive drum. Note that neutralizing light may be irradiated onto the photoconductive drum to reliably remove electric charges having a negative polarity during the leakage detecting operation.

Note that, in the case of the aforementioned touch-down development method, the leakage detecting operation is performed on an image part side of the photoconductive drum. Thus, it is not necessary to remove electric charges having a negative polarity as in the above case. Conversely, toner may adhere to the photoconductive drum 121 (FIG. 1) during the leakage detecting operation. Thus, a transfer voltage having a negative polarity is applied to the transfer member (primary transfer roller) to transfer the toner toward the intermediate transfer belt 125.

Note that, in the case of performing the leakage detecting operation under the above various conditions in the developing devices 122A adopting the two-component development method, leakage first occurred in the developing device 122A of black and the leakage causing voltage VF was 1580 V as a result of a fine adjusting operation (second flow).

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus, comprising:

an image carrier configured to have an electrostatic latent image formed on a surface and carry a toner image;

a developing device including a development housing configured to store a developer containing toner to be charged to a predetermined polarity and carrier, a magnetic roller configured to receive the developer in the development housing and carry a developer layer by being rotated and a developing roller configured to receive the toner from the developer layer, carry a toner layer and supply the toner to the image carrier by being rotated in a state in contact with the developer layer;

a bias applying unit configured to apply development biases, in which an alternating-current voltage is superimposed on a direct-current voltage, to the magnetic roller and the developing roller;

a leakage detecting unit configured to detect leakage occurring between the image carrier and the developing roller or leakage occurring between the developing roller and the magnetic roller;

a bias control unit configured to provide a predetermined potential difference between the magnetic roller and the developing roller so that the toner is transferred from the magnetic roller to the developing roller by controlling the bias applying unit during a developing operation in which the toner is supplied from the developing roller to the image carrier; and a leakage detection control unit configured to perform a leakage detecting operation of detecting a value of an inter-peak voltage, at which the leakage occurred, as a leakage causing voltage at a time different from that of the developing operation while increasing the inter-peak voltage of the alternating-current voltage of the development bias;

wherein:

four or more of developing devices and four or more of bias applying units are arranged in correspondence with different colors of toner; and the leakage detection control unit simultaneously starts the leakage detecting operations for a plurality of developing devices and performs the leakage detecting operations of the developing devices, in which leakage simultaneously occurred, while switching the leakage detecting operations one by one if the leakage simultaneously occurs in a plurality of developing devices at an inter-peak voltage.

2. An image forming apparatus according to claim 1, wherein:

the leakage detection control unit performs a rough adjusting operation of increasing the inter-peak voltage at a first potential interval from a first detection start voltage set in advance and detecting the inter-peak voltage, at which leakage was first detected, as a first leakage causing voltage and a fine adjusting operation of increasing the inter-peak voltage at a second potential interval smaller than the first potential interval from a second detection start voltage smaller than the first leakage causing voltage by the first potential interval until the first leakage causing voltage is reached and detecting the inter-peak voltage, at which leakage was detected again, as a second leakage causing voltage during the leakage detecting operation, and sets the first or second leakage causing voltage as the leakage causing voltage in the leakage detecting operation.

3. An image forming apparatus according to claim 2, wherein:

the leakage detection control unit performs the rough adjusting operation again and performs the fine adjusting operation for each developing device, in which leakage was detected, if the leakage simultaneously occurs in a plurality of developing devices at an inter-peak voltage.

4. An image forming apparatus according to claim 3, wherein:

the leakage detection control unit increases the inter-peak voltage at the first potential interval from a third detection start voltage larger than the first detection start voltage in the rough adjusting operation performed again for each developing device in which the leakage was simultaneously detected.

5. An image forming apparatus according to claim 4, wherein:

the third detection start voltage is smaller than the inter-peak voltage, at which the leakage simultaneously occurred, by the first potential interval.

6. An image forming apparatus according to claim 2, wherein:

if the first leakage causing voltage is detected in one of the plurality of developing devices at an inter-peak voltage, the leakage detection control unit interrupts the leakage detecting operation of the one developing device until the first leakage causing voltages of the other developing devices are detected and successively performs the fine adjusting operation for each developing device after the leakage causing voltages of all the plurality of developing devices are detected.

7. An image forming apparatus according to claim 2, wherein:

if the first leakage causing voltage is detected in one of the plurality of developing devices at an inter-peak voltage, the leakage detection control unit interrupts the leakage detecting operations of the other developing devices and resumes the leakage detecting operations of the other developing devices after the fine adjusting operation of the developing device for which the first leakage causing voltage was detected is performed.

8. An image forming apparatus according to claim 1, wherein:

the four or more bias applying units are adjacently arranged along one direction on a predetermined substrate; and the leakage detection control unit simultaneously performs the leakage detecting operations for two developing devices corresponding to two bias applying units not adjacent on the substrate.

9. An image forming apparatus according to claim 1, wherein:

the leakage detection control unit performs the leakage detecting operation a plurality of times for each developing device; and the bias control unit sets an inter-peak voltage to be applied during the next developing operation of each developing device based on an average or minimum value of a plurality of leakage causing voltages determined by the plurality of leakage detecting operations in each developing device.

10. An image forming apparatus, comprising:

an image carrier configured to have an electrostatic latent image formed on a surface and carry a toner image;

a developing device including a development housing configured to store a developer containing toner to be charged to a predetermined polarity and carrier and a developing roller configured to receive the developer in the development housing, carry a developer layer and supply the toner to the image carrier;

a bias applying unit configured to apply a development bias, in which an alternating-current voltage is superimposed on a direct-current voltage, to the developing roller;

a leakage detecting unit configured to detect leakage occurring between the image carrier and the developing roller;

a bias control unit configured to provide a predetermined potential difference between the image carrier and the developing roller by controlling the bias applying unit during a developing operation in which the toner is supplied from the developing roller to the image carrier; and a leakage detection control unit configured to perform a leakage detecting operation of detecting a value of an inter-peak voltage, at which the leakage occurred, as a leakage causing voltage at a time different from that of the developing operation while increasing the inter-peak voltage of the alternating-current voltage of the development bias;

wherein:

four or more of developing devices and four or more of bias applying units are arranged in correspondence with different colors of toner; and the leakage detection control unit simultaneously starts the leakage detecting operations for a plurality of developing devices and performs the leakage detecting operations of the developing devices, in which leakage simultaneously occurred, while switching the leakage detecting operations one by one if the leakage simultaneously occurs in a plurality of developing devices at an inter-peak voltage.

11. An image forming apparatus according to claim 10, wherein:

the leakage detection control unit performs a rough adjusting operation of increasing the inter-peak voltage at a first potential interval from a first detection start voltage set in advance and detecting the inter-peak voltage, at which leakage was first detected, as a first leakage causing voltage and a fine adjusting operation of increasing the inter-peak voltage at a second potential interval smaller than the first potential interval from a second detection start voltage smaller than the first leakage causing voltage by the first potential interval until the first leakage causing voltage is reached and detecting the inter-peak voltage, at which leakage was detected again, as a second leakage causing voltage during the leakage detecting operation, and sets the first or second leakage causing voltage as the leakage causing voltage in the leakage detecting operation.

12. An image forming apparatus according to claim 11, wherein:

the leakage detection control unit performs the rough adjusting operation again and performs the fine adjusting operation for each developing device, in which leakage was detected, if the leakage simultaneously occurs in a plurality of developing devices at an inter-peak voltage.

13. An image forming apparatus according to claim 12, wherein:

the leakage detection control unit increases the inter-peak voltage at the first potential interval from a third detection start voltage larger than the first detection start voltage in the rough adjusting operation performed again for each developing device in which the leakage was simultaneously detected.

14. An image forming apparatus according to claim 13, wherein:

the third detection start voltage is smaller than the inter-peak voltage, at which the leakage simultaneously occurred, by the first potential interval.

15. An image forming apparatus according to claim 11, wherein:

if the first leakage causing voltage is detected in one of the plurality of developing devices at an inter-peak voltage, the leakage detection control unit interrupts the leakage detecting operation of the one developing device until the first leakage causing voltages of the other developing devices are detected and successively performs the fine adjusting operation for each developing device after the leakage causing voltages of all the plurality of developing devices are detected.

16. An image forming apparatus according to claim 11, wherein:

if the first leakage causing voltage is detected in one of the plurality of developing devices at an inter-peak voltage, the leakage detection control unit interrupts the leakage detecting operations of the other developing devices and resumes the leakage detecting operations of the other developing devices after the fine adjusting operation of the developing device for which the first leakage causing voltage was detected is performed.

17. An image forming apparatus according to claim 10, wherein:

the four or more bias applying units are adjacently arranged along one direction on a predetermined substrate; and the leakage detection control unit simultaneously performs the leakage detecting operations for two developing devices corresponding to two bias applying units not adjacent on the substrate.

18. An image forming apparatus according to claim 10, wherein:

the leakage detection control unit performs the leakage detecting operation a plurality of times for each developing device; and the bias control unit sets an inter-peak voltage to be applied during the next developing operation of each developing device based on an average or minimum value of a plurality of leakage causing voltages determined by the plurality of leakage detecting operations in each developing device.

* * * * *